US009835987B2

(12) United States Patent
Sugiura et al.

(10) Patent No.: US 9,835,987 B2
(45) Date of Patent: Dec. 5, 2017

(54) IMAGE FORMING APPARATUS AND TRANSFER BIAS CONTROL

(71) Applicants: Kenji Sugiura, Kanagawa (JP); Hiroyoshi Haga, Kanagawa (JP); Hirokazu Ishii, Tokyo (JP); Naohiro Kumagai, Kanagawa (JP); Seiichi Kogure, Kanagawa (JP); Junpei Fujita, Kanagawa (JP); Takehide Mizutani, Tokyo (JP); Yuuji Wada, Kanagawa (JP); Naoto Kochi, Kanagawa (JP); Tatsuya Ohsugi, Kanagawa (JP); Kazuki Yogosawa, Kanagawa (JP)

(72) Inventors: Kenji Sugiura, Kanagawa (JP); Hiroyoshi Haga, Kanagawa (JP); Hirokazu Ishii, Tokyo (JP); Naohiro Kumagai, Kanagawa (JP); Seiichi Kogure, Kanagawa (JP); Junpei Fujita, Kanagawa (JP); Takehide Mizutani, Tokyo (JP); Yuuji Wada, Kanagawa (JP); Naoto Kochi, Kanagawa (JP); Tatsuya Ohsugi, Kanagawa (JP); Kazuki Yogosawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/065,600

(22) Filed: Mar. 9, 2016

(65) Prior Publication Data

US 2016/0274503 A1 Sep. 22, 2016

(30) Foreign Application Priority Data

Mar. 19, 2015 (JP) ..... 2015-055972

(51) Int. Cl.
*G03G 15/16* (2006.01)
*G03G 15/00* (2006.01)

(52) U.S. Cl.
CPC ..... *G03G 15/162* (2013.01); *G03G 15/1605* (2013.01); *G03G 15/1675* (2013.01)

(58) Field of Classification Search
CPC ..... G03G 15/1665; G03G 15/1675; G03G 15/162
(Continued)

(56) References Cited

U.S. PATENT DOCUMENTS 5,812,919 A 9/1998 Takano et al.
6,282,386 B1 8/2001 Ishii
(Continued)

FOREIGN PATENT DOCUMENTS

JP 2011-013241 A 1/2011
JP 2012-063746 A 3/2012

OTHER PUBLICATIONS

U.S. Appl. No. 14/881,611, filed Oct. 13, 2015.

*Primary Examiner* — Walter L Lindsay, Jr.
*Assistant Examiner* — Arlene Heredia Ocasio
(74) *Attorney, Agent, or Firm* — Oblon, McClelland, Maier & Neustadt, L.L.P.

(57) ABSTRACT

An image forming apparatus includes an image bearer; a toner image forming device; an intermediate transferor; a primary transfer power source; a secondary transfer nip forming device; and a secondary transfer power source to output a secondary transfer bias. One of two peak values of the secondary transfer bias is a transfer peak value to provide a greater transfer-directional force to move toner from the intermediate transferor toward the recording medium in the secondary transfer nip. An absolute value of the transfer peak value is greater than an absolute value of the primary transfer bias.

13 Claims, 10 Drawing Sheets

(58) Field of Classification Search
USPC ..... 399/314, 66
See application file for complete search history.

(56) References Cited

U.S. PATENT DOCUMENTS

| | | | | |
|---|---|---|---|---|
| 2003/0035658 | A1 | 2/2003 | Ishii | |
| 2007/0212139 | A1 | 9/2007 | Sugiura et al. | |
| 2008/0187352 | A1* | 8/2008 | Takeuchi | G03G 15/161 399/101 |
| 2008/0310897 | A1 | 12/2008 | Naruse et al. | |
| 2010/0008706 | A1 | 1/2010 | Sugiura et al. | |
| 2010/0040386 | A1 | 2/2010 | Mizutani et al. | |
| 2010/0329707 | A1* | 12/2010 | Yamada | G03G 15/161 399/44 |
| 2011/0103822 | A1 | 5/2011 | Sugiura et al. | |
| 2011/0229187 | A1 | 9/2011 | Hozumi et al. | |
| 2012/0008973 | A1 | 1/2012 | Sakakibara et al. | |
| 2012/0045259 | A1 | 2/2012 | Nakamura et al. | |
| 2012/0237271 | A1 | 9/2012 | Sengoku et al. | |
| 2012/0308250 | A1 | 12/2012 | Shimizu et al. | |
| 2012/0315058 | A1 | 12/2012 | Shimizu et al. | |
| 2013/0004190 | A1 | 1/2013 | Sengoku et al. | |
| 2013/0011155 | A1 | 1/2013 | Ogiyama et al. | |
| 2013/0089363 | A1 | 4/2013 | Mimbu et al. | |
| 2013/0129395 | A1* | 5/2013 | Kubo | G03G 15/162 399/302 |
| 2013/0136468 | A1 | 5/2013 | Shimizu et al. | |
| 2013/0136477 | A1 | 5/2013 | Ogiyama et al. | |
| 2013/0164011 | A1* | 6/2013 | Nakamura | G03G 15/1675 399/66 |
| 2013/0177329 | A1 | 7/2013 | Tanaka et al. | |
| 2013/0236201 | A1 | 9/2013 | Mizutani et al. | |
| 2013/0308968 | A1 | 11/2013 | Tanaka et al. | |
| 2014/0029988 | A1* | 1/2014 | Shimizu | G03G 15/1665 399/314 |
| 2014/0064769 | A1 | 3/2014 | Sugiura | |
| 2014/0241744 | A1 | 8/2014 | Ichikawa et al. | |
| 2014/0270819 | A1 | 9/2014 | Wada et al. | |
| 2014/0314435 | A1 | 10/2014 | Kato et al. | |
| 2015/0030342 | A1* | 1/2015 | Yoshioka | G03G 15/80 399/66 |
| 2016/0041508 | A1 | 2/2016 | Kogure et al. | |

* cited by examiner

IMAGE FORMING APPARATUS AND TRANSFER BIAS CONTROL

CROSS-REFERENCE TO RELATED APPLICATION

This patent application is based on and claims priority pursuant to 35 U.S.C. §119(a) to Japanese Patent Application No. 2015-055972, filed on Mar. 19, 2015, in the Japan Patent Office, the entire disclosure of which is hereby incorporated by reference herein.

BACKGROUND

Technical Field

Aspects of the present disclosure relate to an image forming apparatus.

Related Art

An image forming apparatus is known that primarily transfers a toner image from an image bearer to an intermediate transferor with a primary transfer bias including only a direct current voltage applied, and that further secondarily transfers the toner image from the intermediate transferor to a recording sheet with a secondary transfer bias including a superimposed voltage, in which an alternating current voltage is superimposed on the direct current voltage.

For example, in such an image forming apparatus, a primary transfer power source outputs the primary transfer bias including only the direct current voltage to primarily transfer a toner image from each photoconductor as the image bearer onto an intermediate transfer belt in a primary transfer nip formed between each photoconductor and the intermediate transfer belt. In addition, a secondary transfer power source outputs a secondary transfer bias including the superimposed voltage to secondarily transfer the toner image from the intermediate transfer belt onto a recording sheet in a secondary transfer nip formed between the intermediate transfer belt and a nip forming roller.

SUMMARY

In an aspect of this disclosure, there is provided an image forming apparatus including an image bearer having a surface to bear a toner image; a toner image forming device configured to form the toner image on the surface of the image bearer; an intermediate device configured to contact the surface of the image bearer to form a primary transfer nip; a primary transfer power source configured to output a primary transfer bias including only a direct current voltage to the primary transfer nip to transfer the toner image from the surface of the image bearer onto a surface of the intermediate transferor; a secondary transfer nip forming device configured to contact the intermediate transferor to form a secondary transfer nip; and a secondary transfer power source configured to output a secondary transfer bias including a superimposed voltage, in which an alternating current voltage is superimposed on the direct current voltage, to the secondary transfer nip to secondarily transfer the toner image from the intermediate transferor onto a recording medium disposed in the secondary transfer nip. One of two peak values of the secondary transfer bias is a transfer peak value to provide a greater transfer-directional electrostatic force to move toner from the intermediate transferor toward the recording medium in the secondary transfer nip. An absolute value of the transfer peak value is greater than an absolute value of the primary transfer bias.

In another aspect of this disclosure, there is provided an image forming apparatus, including: an image bearer having a surface to bear a toner image; a toner image forming device configured to form the toner image on the surface of the image bearer; an intermediate transferor configured to contact the surface of the image bearer to form a primary transfer nip; a primary transfer power source configured to output a primary transfer bias including only a direct current voltage to the primary transfer nip to transfer the toner image from the surface of the image bearer onto a surface of the intermediate transferor; a secondary transfer nip forming device configured to contact the intermediate transferor to form a secondary transfer nip; and a secondary transfer power source configured to output a secondary transfer bias including a superimposed voltage, in which an alternating current voltage is superimposed on the direct current voltage, to the secondary transfer nip to secondarily transfer the toner image from the intermediate transferor onto a recording medium disposed in the secondary transfer nip. One of two peak values of the secondary transfer bias is a transfer peak value to provide a greater transfer-directional force to move toner from the intermediate transferor toward the recording medium in the secondary transfer nip. An absolute value of an opposite-polarity peak value having an opposite polarity to a polarity of the transfer peak value is smaller than an absolute value of the primary transfer bias.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
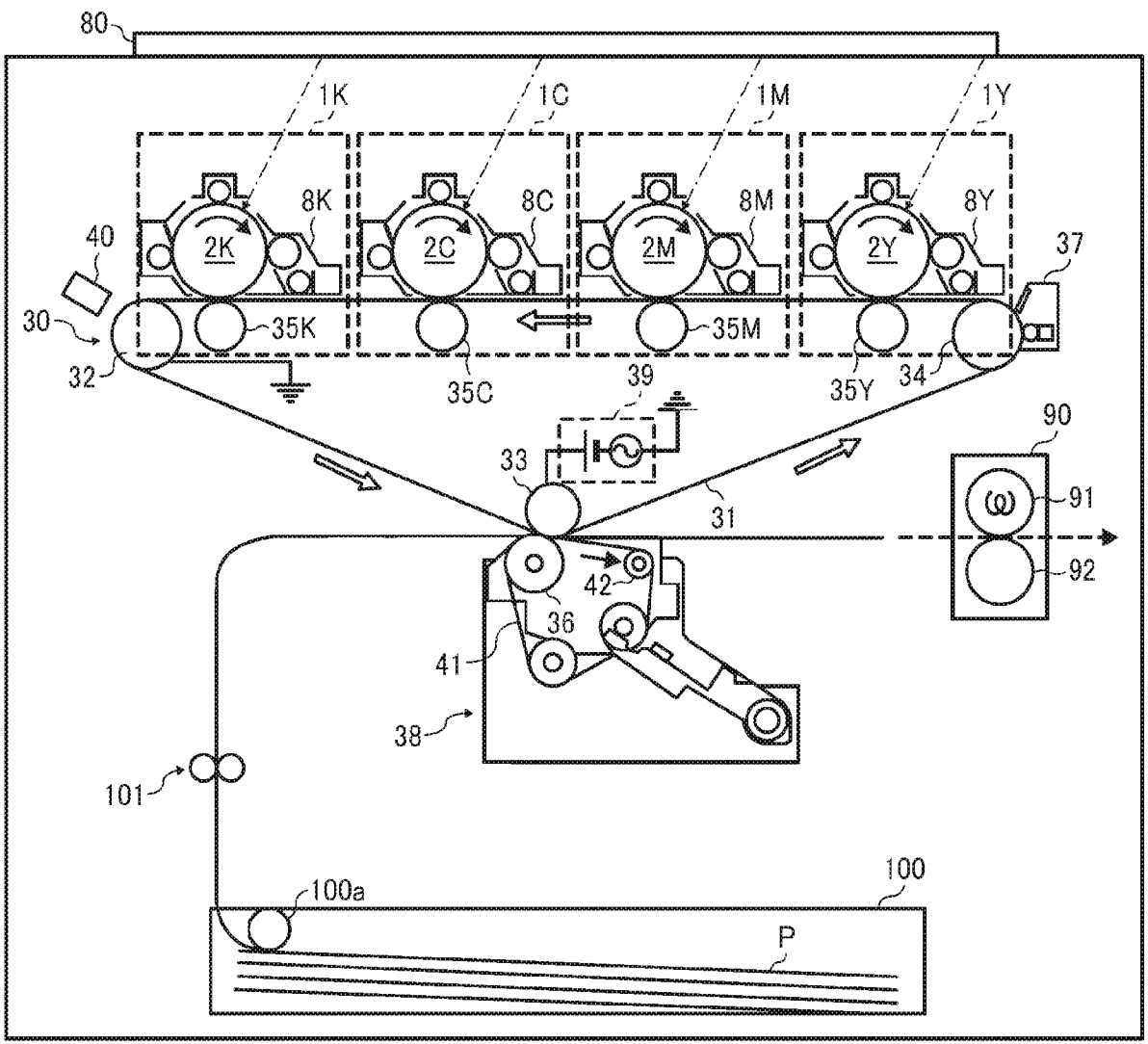
FIG. 1 is a schematic view of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

With reference to FIG. 1, a description is provided of an electrophotographic color printer as an example of an image forming apparatus 1000 according to an embodiment of the present disclosure. The various aspects of the present specification can adapt to, not limited to a printer (an image forming apparatus), other types of image forming apparatuses such as multicolor copiers, fax machines, scanners, and multifunction peripherals having these capabilities.

A basic configuration of the image forming apparatus 1000 is described below. FIG. 1 is a schematic view of the image forming apparatus 1000. As illustrated in FIG. 1, the image forming apparatus 1000 includes four toner image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming, apparatus 1000 also includes a transfer unit 30 serving as a transfer device, an optical writing unit 80, a fixing device 90, a sheet cassette 100, and a pair of registration rollers 101.

Figure 2:
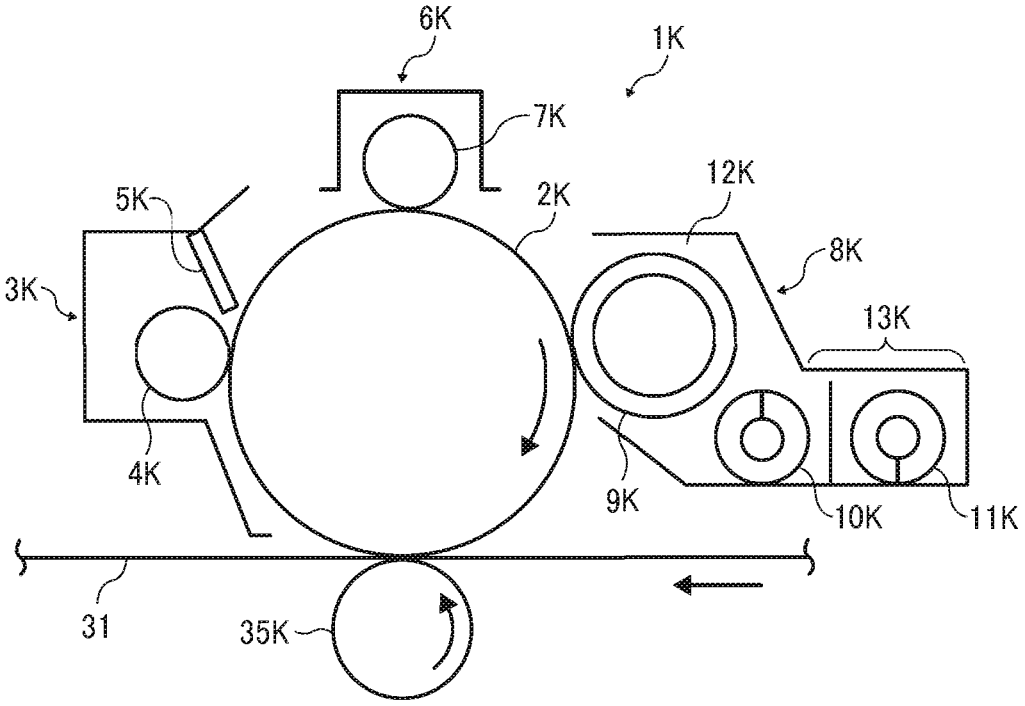
FIG. 2 is an enlarged view of a toner image forming unit for black color as a representative example of toner image forming units employed in the image forming apparatus of FIG. 1.

The image forming units 1Y, 1M, 1C, and 1K all have the same configuration, differing in the color of toner employed. The image forming units 1Y, 1M, 1C, and 1K are replaced upon reaching their product life cycles. FIG. 2 is a schematic diagram of the toner image forming unit 1K. The toner image fainting unit 1K includes a photoconductor 2K as an image bearer that bears an image. The photoconductor 2K is surrounded by various pieces of imaging equipment, such as a charging device 6K, a developing device 8K, a photoconductor cleaner 3K, and a charge remover. These devices are held by a common holder so that they are detachably attachable and replaced at the same time.

The photoconductor 2K includes a drum-shaped base on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby charging uniformly the surface of the photoconductor 2K. According to the present embodiment, the photoconductor 2K is uniformly charged negatively, which is the same polarity as that of normally-charged toner. As a charging bias, an alternating current (AC) voltage superimposed on a direct current (DC) voltage is employed. The charging roller 7K includes a metal cored bar coated with a conductive elastic layer made of a conductive elastic material. According to the present embodiment, the photoconductor 2K is charged by the charging roller 7K contacting the photoconductor 2K or disposed near the photoconductor 2K. Alternatively, a corona charger may be employed.

The uniformly charged surface of the photoconductor 2K is scanned by laser light projected from the optical writing unit 80, thereby forming an electrostatic latent image for black on the surface of the photoconductor 2K. The electrostatic latent image for black on the photoconductor 2K is developed with black toner by the developing device 8K. Accordingly, a visible image, also known as a toner image of black, is formed on the photoconductor 2K. As will be described later in detail, the toner image is transferred primarily onto an intermediate transfer belt 31 in a process known as a primary transfer process.

The image-bearer cleaning device 3K removes residual toner remaining on the surface of the photoconductor 2K after the primary transfer process, that is, after the photoconductor 2K passes through a primal transfer nip. The image-bearer cleaning device 3K includes a brush roller 4K and a cleaning blade 5K. The cleaning blade 5K is cantilevered, that is, one end of the cleaning blade 5K is fixed to the housing of the photoconductor cleaner 3K, and its free end contacts the surface of the photoconductor 2K. The brush roller 4K rotates and brushes off the residual toner from the surface of the photoconductor 2K while the cleaning blade 5K removes the residual toner by scraping.

The charge remover removes residual charge remaining on the photoconductor 2K after the surface thereof is cleaned by the photoconductor cleaner 3K. The surface of the photoconductor 2K is initialized in preparation for the subsequent imaging cycle.

The developing device 8K as a developer bearer includes a developing portion 12K and a developer conveyor 13K. The developing portion 12K includes a developing roller 9K inside thereof. The developer conveyor 13K stirs a black developing agent and transports the black developing agent. The developer conveyor 13K includes a first chamber equipped with a first screw 10K and a second chamber equipped with a second screw 11K. The first screw 10K and the second screw 11K are each constituted of a rotatable shaft and helical fighting wrapped around the circumferential surface of the shaft. Each end of the shaft of the first screw 10 and the second screw 11K in the axial direction of the shaft is rotatably held by shaft bearings.

The first chamber with the first screw 10K and the second chamber with the second screw 11K are separated by a wall, but each end of the wall in the axial direction of the screw shaft has a connecting hole through which the first chamber and the second chamber communicate. The first screw 10K mixes the developing agent by rotating the helical fighting and carries the developing agent from the distal end to the proximal end of the screw in the direction perpendicular to the drawing plane while rotating. The first screw 10K is disposed parallel to and facing the developing roller 9K. The black developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K passes through the connecting hole in the wall near the proximal side and enters the second chamber. Subsequently, the developing agent is carried by the helical fighting of the second screw 11K. As the second screw 11K rotates, the developing agent is delivered from the proximal end to the distal end in FIG. 2 while being mixed in the direction of rotation.

In the second chamber, a toner density sensor to detect the density of the toner in the developing agent is disposed at the bottom of a casing of the chamber. As the toner density sensor, a magnetic permeability detector is employed. There is a correlation between the toner density and the magnetic permeability of the developing agent consisting of toner particles and magnetic carrier particles. Therefore, the magnetic permeability detector can detect the density of the toner.

Although not illustrated, the image forming apparatus 1000 includes toner supply devices to supply independently toners of yellow, magenta, cyan, and black to the second chamber of the respective developing devices 8Y 8M, 8C, and 8K. The controller of the image forming apparatus 1000 includes a Random Access Memory (RAM) to store a target output voltage Vtref for output voltages provided by the toner density sensors for yellow, magenta, cyan, and black. If the difference between the output voltages provided by the toner density sensors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of each of the developing devices 8Y 8M, 8C, and 8K, so that the toner density of the developer for each color maintains within a predetermined range.

The developing roller 9K in the developing portion 12K faces the first screw 10K as well as the photoconductor 2K through an opening formed in the casing of the developing device 8K. The developing roller 9K includes a cylindrical developing sleeve made of a non-magnetic pipe which is rotated, and a magnetic roller disposed inside the developing sleeve. The magnetic roller is fixed so as not to rotate together with the developing sleeve. The black developing agent supplied from the first screw 10K is carried on the surface of the developing sleeve due to the magnetic force of the magnetic roller. As the developing sleeve rotates, the developing agent is transported to a developing area facing the photoconductor 2K.

The developing sleeve is supplied with a developing bias having the same polarity as the polarity of toner. An absolute value of the developing bias is greater than the potential of the electrostatic latent image on the photoconductor 2K, but less than the charge potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A background potential acts between the developing sleeve and a background portion (non-image formation area) of the photoconductor 2K, causing the toner on the developing sleeve to move to the sleeve surface. Due to the background potential and the non-developing potential, the toner on the developing sleeve moves selectively to the electrostatic latent image formed on the photoconductor 2K, thereby forming a visible image, known as a toner image.

Similar to the toner image forming unit 1K, toner images of yellow, magenta, and cyan are formed on the photoconductors 2Y, 2M, and 2C of the toner image forming units 1Y, 1M, and 1C, respectively. The optical writing unit 80 for writing a latent image on the photoconductors 2 is disposed above the toner image forming units 1Y, 1M, 1C, and 1K. Based on image information provided by an external device such as a personal computer (PC), the optical writing unit 80 illuminates the photoconductors 2Y, 2M, 2C, and 2K with the laser light projected from a laser diode of the optical writing unit 80. Accordingly, the electrostatic latent images of yellow, magenta, cyan, and black are formed on the photoconductors 2Y, 2M, 2C, and 2K, respectively. The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photoconductor 2Y. Alternatively, the optical writing unit 80 may employ a light source using an LED array including a plurality of LEDs that projects light.

The transfer unit 30 is disposed below the toner image forming units 1Y, 1M, 1C, and 1K. The transfer unit 30 includes the intermediate transfer belt 31 serving as an image bearing member formed into an endless loop and rotated in the counterclockwise direction. The transfer unit 30 also includes a plurality of rollers: a drive roller 32, a secondary-transfer first roller 33, a cleaning auxiliary roller 34, and four primary transfer rollers 35Y, 35M, 35C, and 35K (which may be referred to collectively as primary transfer rollers 35). The transfer unit 30 further includes a belt cleaning device 37 and a density sensor 40.

The intermediate transfer belt 31 is entrained around and stretched taut between the plurality of rollers. i.e., the drive roller 32, the secondary-transfer first roller 33, the cleaning auxiliary roller 34, and the four primary transfer rollers 35Y, 35M, 35C, and 35K. The drive roller 32 is rotated in the counterclockwise direction by a motor or the like, and rotation of the driving roller 32 enables the intermediate transfer belt 31 to rotate in the same direction.

The intermediate transfer belt 31 is interposed between the photoconductors 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K. The yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electrical field and the nip pressure. The intermediate transfer belt 31, on which the yellow toner image has been transferred, sequentially passes through the primary transfer nips of magenta, cyan, and black. Subsequently, the toner images on the photoconductors 2M, 2C, and 2K are superimposed on the yellow toner image which has been transferred on the intermediate transfer belt 31, one atop the other, thereby fainting a composite toner image on the intermediate transfer belt 31 in the primary transfer process. Accordingly, the composite toner image, in which the toner images of yellow, magenta, cyan, and black are superimposed one atop the other, is formed on the surface of the intermediate transfer belt 31. According to the present embodiment described above, a roller-type transfer device (here, the primary transfer rollers 35) is used as a primary transfer device. Alternatively, a transfer charger or a brush-type transfer device may be employed as a primary transfer device.

A sheet conveyor unit 38, disposed substantially below the transfer unit 30, includes a secondary-transfer second roller 36 disposed opposite to the secondary-transfer first roller 33 via the intermediate transfer belt 31 and a sheet conveyor belt 41 (generally referred to as a secondary transfer belt or a secondary transfer member). As illustrated in FIG. 1, the sheet conveyor belt 41 is formed into an endless loop and looped around a plurality of rollers including the secondary-transfer second roller 36. As the secondary-transfer second roller 36 is driven to rotate, the sheet conveyor belt 41 is rotated in the clockwise direction in FIG. 1 The secondary-transfer second roller 36 contacts, via the sheet conveyor belt 41, a portion of the front surface or the image bearing surface of the intermediate transfer belt 31 looped around the secondary-transfer first roller 33, thereby forming a secondary transfer nip therebetween. That is, the intermediate transfer belt 31 and the sheet conveyor belt 41 are interposed between the secondary-transfer first roller 33 of the transfer unit 30 and the secondary-transfer second roller 36 of the sheet conveyor unit 38. Accordingly, the outer peripheral surface or the image bearing surface of the intermediate transfer belt 31 contacts the outer peripheral surface of the sheet conveyor belt 41 serving as the nip forming member, thereby forming the secondary transfer nip. The secondary-transfer second roller 36 disposed inside the loop of the sheet conveyor belt 41 is grounded; whereas, a secondary transfer bias is applied to the secondary-transfer first roller 33 disposed inside loop of the intermediate transfer belt 31 by a secondary transfer power source 39. With this configuration, a secondary transfer electrical field is formed between the secondary-transfer first roller 33 and the secondary-transfer second roller 36 so that the toner having a negative polarity is transferred electrostatically from the secondary-transfer first roller 33 to the secondary-transfer second roller 36. Alternatively, instead of the sheet conveyor belt 41, a secondary transfer roller may be employed as the nip forming device to contact directly the intermediate transfer belt 31.

As illustrated in FIG. 1, the sheet cassette 100 storing a sheaf of recording sheets P as a recording medium is disposed below the transfer unit 31. The sheet cassette 100 is equipped with a feed roller 100*a* that contacts the top sheet of the sheaf of recording sheets P. As the feed roller 100*a* is rotated at a predetermined speed, the sheet feed roller 100*a* picks up and sends the top sheet of the recording sheets P to a sheet delivery path. Substantially near the end of the sheet delivery path, the pair of registration rollers 101 is disposed. The pair of registration rollers 101 stops rotating temporarily as soon as the recording sheet P fed from the sheet cassette 100 is interposed between the pair of registration rollers 101. The pair of registration rollers 101 starts to rotate again to feed the recording sheet P to the secondary transfer nip in appropriate timing such that the recording sheet P is aligned with the composite toner image formed on the intermediate transfer belt 31 at the secondary transfer nip. In the secondary transfer nip, the recording sheet P tightly contacts the composite toner image on the intermediate transfer belt 31, and the composite toner image is secondarily transferred onto the recording sheet P by the secondary transfer electric field and the nip pressure applied thereto, thereby forming, a full-color toner image on the recording sheet P. The recording sheet P, on which the full-color toner image is formed, passes through the secondary transfer nip and separates from the intermediate transfer belt 31 due to self-stripping. Furthermore, the curvature of a separation roller 42, around which the sheet conveyor belt 41 is looped, enables the recording sheet P to separate from the sheet conveyor belt 41.

According to the present embodiment, the sheet conveyor belt 41 as the nip forming device contacts the intermediate transfer belt 31 to form the secondary transfer nip. Alternatively, a nip forming roller as the nip forming device may contact the intermediate transfer belt 31 to form the secondary transfer nip.

After the intermediate transfer belt 31 passes through the secondary transfer nip N, residual toner not having been transferred onto the recording sheet P remains on the intermediate transfer belt 31. The residual toner is removed from the intermediate transfer belt 31 by the belt cleaning device 37 which contacts the surface of the intermediate transfer belt 31. The cleaning auxiliary roller 34 disposed inside the loop formed by the intermediate transfer belt 31 supports the cleaning operation performed by the belt cleaning device 37.

As illustrated in FIG. 1, the density sensor 40 is disposed outside the loop formed by the intermediate transfer belt 31. More specifically, the density sensor 40 faces a portion of the intermediate transfer belt 31 looped around the drive roller 32 with a predetermined gap between the density sensor 40 and the intermediate transfer belt 31. An amount of toner adhered to the toner image per unit area (image density,) primarily transferred onto the intermediate transfer belt 31 is measured when the toner image comes to the position opposite to the density sensor 40.

The fixing device 90 is disposed downstream from the secondary transfer nip in the direction of conveyance of the recording sheet P. The fixing device 90 includes a fixing roller 91 and a pressing roller 92. The fixing roller 91 includes a heat source such as a halogen lamp inside the fixing roller 91. While rotating, the pressing roller 92 pressingly contacts the fixing roller 91, thereby forming a heated area called a fixing nip therebetween. The recording sheet P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording sheet P in the fixing nip. Subsequently, the recording sheet P is output outside the image forming apparatus from the fixing device 90 via a post-fixing delivery path after the fixing process.

According to the present embodiment, for forming a monochrome image, an orientation of a support plate supporting the primary transfer rollers 35Y, 35M, and 35C of the transfer unit 30 is changed by driving a solenoid or the like. With this configuration, the primary transfer rollers 35Y, 35M, and 35C are separated from the photoconductors 2Y, 2M, and 2C, thereby separating the outer peripheral surface or the image bearing surface of the intermediate transfer belt 31 from the photoconductors 2Y, 2M, and 2C. 1n a state in which the intermediate transfer belt 31 contacts only the photoconductor 2K, only the toner image forming unit 1K for black among four toner image forming units (1Y, 1M, 1C, and 1K) is driven to form a black toner image on the photoconductor 2K. It is to be noted that the present disclosure can be applied to both an image forming apparatus for forming a color image and a monochrome image forming apparatus for forming a single-color image.

Figure 3:
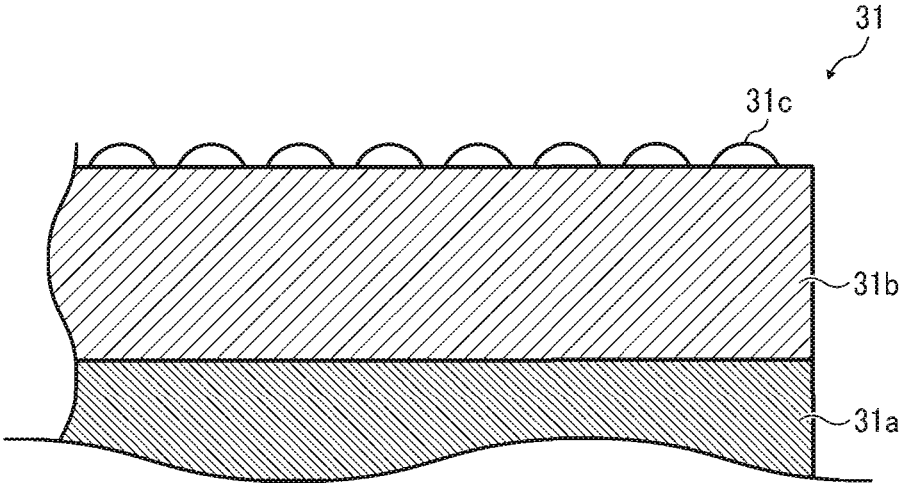
FIG. 3 is a block diagram of one example of a control system of the image fainting apparatus of FIG. 1.
Figure 4:
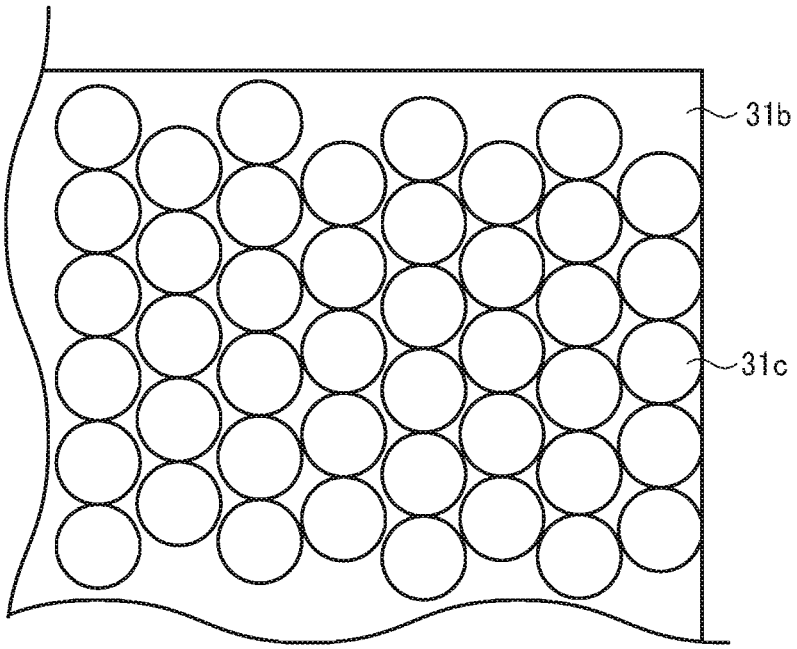
FIG. 4 is a block diagram of one example of change in frequency of a secondary transfer bias.

FIG. 3 is a partially enlarged cross-sectional view schematically illustrating a transverse plane of the intermediate transfer belt 31. As illustrated in FIG. 4, the intermediate transfer belt 31 includes a base layer 31*a* and an elastic layer 31*b*. The base layer 31*a* formed into an endless looped belt is formed of a material having a high stiffness, but having some flexibility. The elastic layer 31*b* disposed on the front surface of the base layer 31*a* is formed of an elastic material with high elasticity. Particles 31*c* are dispersed in the elastic layer 31*b*. While a portion of the particles 31*c* projects from the elastic layer 31*b*, the particles 31*c* are arranged concentratedly in a belt surface direction as illustrated in FIG. 4. With these particles 31*c*, an uneven surface of the belt with a plurality of bumps is formed on the intermediate transfer belt 31.

Examples of materials for the base layer 31*a* include, but are not limited to, a resin in which an electrical resistance adjusting material made of a filler or an additive is dispersed to adjust electrical resistance. Examples of the resin constituting the base layer 31*a* include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 31*a*, as needed. The coating solution is a liquid resin before curing in which electrical resistance adjusting materials are dispersed. An amount of the electrical resistance adjusting materials to be dispersed in the base layer 31*a* of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt) in which the electrical characteristics (i.e., the surface resistivity and the volume resistivity) and the mechanical strength are well balanced. The content of the electrical resistance adjusting material in the coating liquid when using carbon black is in a range from 10% through 25% by weight or preferably, from 15% through 20% by weight relative to the solid content. The content of the electrical resistance adjusting material in the coating liquid when using metal oxides is approximately 1% through 50% by weight or more preferably, in a range from 10% through 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 61 drops, which is undesirable in actual use.

The thickness of the base layer 31*a* is not limited to a particular thickness and can be selected as needed. The thickness of the base layer 31*a* is preferably in a range from 30 μm to 150 μm, more preferably in a range from 40 μm to 120 μm, even more preferably, in a range from 50 μm to 80 μm. The base layer 31*a* having a thickness of less than 30 μm cracks and gets torn easily. The base layer 31*a* having a thickness of greater than 150 μm cracks when it is bent. By contrast, if the thickness of the base layer 31*a* is in the above-described respective range, the durability is enhanced.

In order to increase the stability of traveling of the intermediate transfer belt 31, preferably, the thickness of the base layer 31*a* is uniform as much as possible. An adjustment method to adjust the thickness of the base layer 31*a* is not limited to a particular method, and can be selected as needed. For example, the thickness of the base layer 31*a* can be measured using a contact-type or an eddy-current thickness meter or a scanning electron microscope (SEM) which measures a cross-section of the film.

As described above, the elastic layer 31*b* of the intermediate transfer belt 31 includes a plurality of raised portions with the particles 31*c* dispersed in the elastic layer 31*b*, Examples of elastic materials for the elastic layer 31*b* include, but are not limited to, generally-used resins, elastomers, and rubbers. Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials. In particular, in order to accommodate a recording sheet with an uneven surface such as Leathac (registered trademark), soft materials are preferable. Because the particles 31*c* are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 31*b*. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine, Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis (4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 to 20 parts by weight, more preferably, from 0.1 to 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 31*b*. The type of crosslinking promoter is not limited particularly. However, it is preferable that the crosslinking promoter can be used with the above-described multivalent amine crosslinking agents. Such crosslinking promoters include, but are not limited to, guartidino compounds, imidazole compounds, quaternary onium salts, tertiary phosphine compounds, and weak acid alkali metal salts. Examples of the guanidino compounds include, but are not limited to, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0] undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 to 20 parts by weight, more preferably, from 0.3 to 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. through 220° C., more preferably, 140° C. through 200° C. The crosslinking time period is preferably in a range of 30 seconds through 5 hours. The heating methods can be chosen from those which are used for crosslinking rubber compositions, such as press heating, steam heating, oven heating, and hot-air heating. In order to reliably crosslink the inside of the crosslinked product, post crosslinking may be additionally carried out after crosslinking, is carried out once. The post crosslinking time period varies depending on the heating method, the crosslinking temperature and the shape of crosslinked product, but is carried out preferably for 1 through 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight to 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 31*b* is, preferably, in a range from $1\times10^{8}$ Ω/sq to $1\times10^{13}$ Ω/sq, and the volume resistivity of the elastic layer 31*b* is, preferably, in a range from $1\times10^{6}$ Ω·cm to $1\times1.0^{12}$ 106 ·cm. In order to obtain high toner transferability relative to an uneven surface of a recording sheet as is desired in image forming apparatuses using electrophotography in recent years, it is preferable to adjust a micro rubber hardness of the elastic layer 31*b* to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the upper most layer of the intermediate transfer belt 31 with a relatively low deformation capability as a whole, the micro-hardness decreases. In such a configuration, the intermediate transfer belt 31 with a low deformation capability does not conform to the surface condition of the uneven surface of the recording sheet, thereby impairing the desired transferability relative to the uneven surface of the recording sheet. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 31*b* is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 31*b* to sag easily due to its own weight, resulting in unstable movement of the intermediate transfer belt 31 and damage to the intermediate transfer belt 31 looped around rollers. The layer thickness can be measured by observing the cross-section of the elastic layer 31*b* using a scanning electron microscope (SEM), for example.

The particle 31*c* to be dispersed in the elastic material of the elastic layer 31*b* is a spherical resin particle having an average particle diameter of equal to or less than 100 μm and are insoluble in an organic solvent. Furthermore, the 3% thermal decomposition temperature of these resin particles is equal to or greater than 200° C. The resin material of the particle 31*c* is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle is, the more preferred. Preferably, the volume average particle diameter of the particle is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ± (Average particle diameter×0.5 μm). With the particle diameter of the particle 31*c* less than 1.0 μm, enhancement of transfer performance by the particle 31*c* cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 31*c* made of resin material has a relatively high insulation property. Thus, if the particle diameter is too large, accumulation of electrical charges of the particle diameter 31*c* during, continuous printing causes image defect easily.

Either commercially-available products or laboratory-derived products may be used as the particle 31*c*. The thus-obtained particle 31*c* is directly applied to the elastic layer 31*b* and evened out, thereby evenly distributing the particle 31*c* with ease. With this configuration, an overlap of the particles 31*c* in the belt thickness direction is reduced, if not prevented entirely. Preferably, the cross-sectional diameter of the plurality of particles 31*c* in the surface direction of the elastic layer 31*b* is as uniform as possible. More specifically, the distribution width thereof is equal to or less than ± (Average particle diameter×0.5 μm). For this reason, preferably, powder including particles with a small particle diameter distribution is used as the particles 31*c*. If the particles 31*c* having a specific particle diameter can be applied to the elastic layer 31*b* selectively, it is possible to use particles having a relatively large particle diameter distribution. It is to be noted that timing at which the particles 31*c* are applied to the surface of the elastic layer 31*b* is not particularly limited. The particles 31*c* can be applied before or after crosslinking of the elastic material of the elastic layer 31*b*.

Preferably, a projected area ratio of a portion of the elastic layer 31*b* having the particles 31*c* relative to the elastic layer 31*b* with its surface being exposed is equal to or greater than 60% in the surface direction of the elastic layer 31*b*. In a case in which the projected area ratio is less than 60%, the frequency of direct contact between toner and the pure surface of the elastic layer 31*b* increases, thereby degrading transferability of toner, cleanability of the belt surface from which toner is removed, and filming resistance. In some embodiments, a belt without the particles 31*c* dispersed in the elastic layer 31*b* can be used as the intermediate transfer belt 31.

As illustrated in FIG. 4, no particles 31*c* overlapping each other are observed on the surface of the intermediate transfer belt 31. Preferably, the cross-sectional diameters of the plurality of particles 31*c* in the surface of the elastic layer 31*b* are as uniform as possible. More specifically, the distribution width thereof is preferably equal to or less than ± (Average particle diameter×0.5 μm). For this reason, preferably, powder including particles with a small particle diameter distribution is used as the particles. If the particles 31*c* having a specific particle diameter can be selectively localized in the elastic layer 31*b*, power including particles with a lame particle diameter distribution may be used.

Figure 5:
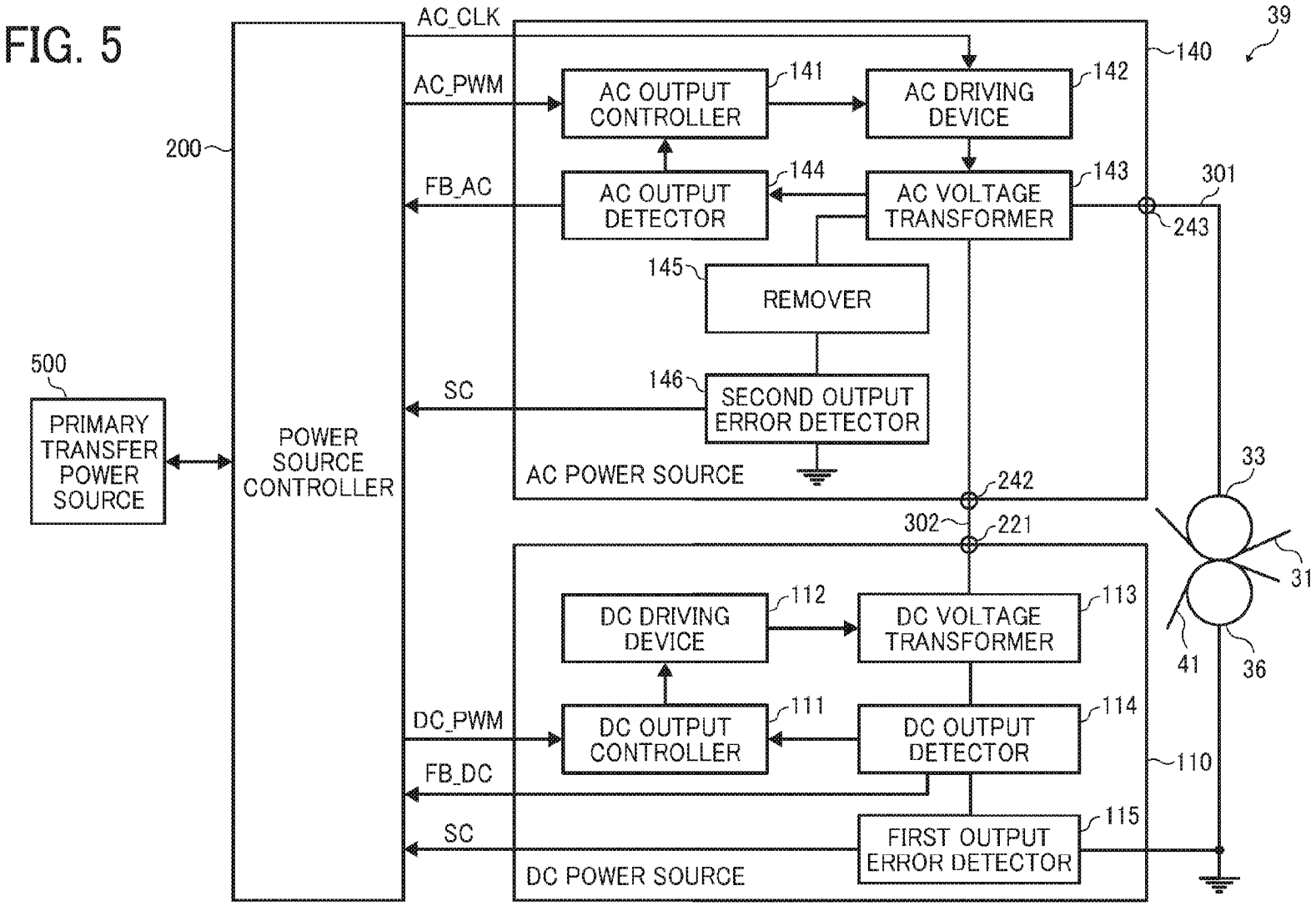
FIG. 5 is a chart of one example of a voltage waveform of a secondary bias output from a secondary transfer power source under control of a controller.

When paper having an uneven surface, such as Japanese paper called "Washi" is used as a recording sheet P, an elastic layer 31*b* having good elasticity is used to successfully secondarily transfer toner onto recessed portions of the recording sheet P, which prevents uneven image density according to the uneven surface. However, such an elastic layer 31*b* is not practical because the elastic layer 31*b* easily elongates after being stretched out. This is because, the elastic layer 31*b* includes a base layer 31*a* having more rigidity than the elastic layer 31*b*, which suppresses the elongation of the entire belt over a long time period, FIG. 5 is a block diagram of a portion of an electrical circuit of a secondary transfer power source, and the secondary-transfer first roller 33, and the secondary-transfer second roller 36 according to an embodiment of the present disclosure. As illustrated in FIG. 5, the secondary transfer power source 39 includes a direct current (DC) power source 110 and an alternating current (AC) power source 140, a power source controller 200, and so forth. The AC power source 140 is detachably mountable relative to a main body of the secondary transfer power source 39. The DC power source 110 outputs a DC voltage to apply an electrostatic force to toner on the intermediate transfer belt 31 so that the toner moves from the intermediate transfer belt 31 to the recording sheet P in the secondary transfer nip. The DC power source 110 includes a DC output controller 111, a DC driving device 112, a DC voltage transformer 113, a DC output detector 114, a first output error detector 115, and an electrical connector 221.

The AC power source 140 outputs an alternating current voltage to form an alternating electric field in the secondary transfer nip N. The AC power source 140 includes an AC output controller 141, an AC driving device 142, an AC voltage transformer 143, an AC output detector 144, a remover 145, a second output error detector 146, electrical connectors 242 and 243, and so forth.

The power source controller 200 controls the DC power source 110 and the AC power source 140, and is equipped with a central processing unit (CPU), a Read Only Memory (ROM), and a Random Access Memory (RAM). The power source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal. The DC_PWM signal controls an output level of the DC voltage. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 301 so that the DC voltage transformer 113 outputs (applies) a DC voltage to the secondary-transfer first roller 33 via the harness 301. In a case in which the AC power source 140 is connected, the electrical connector 221 and the electrical connector 242 are electrically connected by a harness 302 so that the DC voltage transformer 113 outputs a DC voltage to the AC power source 140 via the harness 302.

The DC output detector 114 detects and outputs an output value of the DC high voltage from the DC voltage transformer 113 to the DC output controller 111. The DC output detector 114 outputs the detected output value as a FB_DC signal (feedback signal) to the power source controller 200 to control the duty of the DC_PWM signal in the power source controller 200 so as not to impair transferability due to environment and load. According to the present embodiment, the AC power source 140 is detachably mountable relative to the main body of the secondary transfer power source 39. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present embodiment, the DC power source 110 is under constant-current control. Alternatively, in some embodiments, the DC power source 110 can be under constant voltage control as long as the high voltage to be applied to the secondary-transfer first roller 33 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage to the power source controller 200. With this configuration, the power source controller 200 can stop the DC power source 110 to output the high voltage.

The power source controller 200 inputs an AC_PWM signal and an output value of the AC voltage transformer 143 detected by the AC output detector 144. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the: C voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary-transfer first roller 33 are electrically connected by the harness 301, the AC voltage transformer 143 outputs (applies) the thus-obtained superimposed voltage to the secondary-transfer first roller 33 via the harness 301. In a case in which the AC voltage transformer 143 does not generate the AC voltage, the AC voltage transformer 143 outputs (applies) the DC high voltage output from the DC voltage transformer 113 to the secondary-transfer first roller 33 via the harness 301. Subsequently, the voltage (the superimposed voltage or the DC voltage) provided to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the power source controller 200 to control the duty of the AC_PWM signal in the power source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC voltage power source 140) is either a sine wave or a square wave. According to the present embodiment, the waveform of the AC voltage is a short-pulse square wave. The AC voltage having a short-pulse square wave can enhance image quality.

The power source controller 200 is connected to a primary transfer power source 500. The primary transfer power source 500 outputs primary transfer bias including the DC voltage to each of the primary transfer roller 35Y, 35M, 35C, and 35K. In this case, the output primary transfer bias is under constant current control. The power controller 200 outputs a rewriting signal to rewrite the target values of output current for yellow, magenta, cyan, and black as appropriate, so as to perform constant current control on the primary transfer bias for yellow, magenta, cyan, and black stored in the primary transfer power source 500.

Figure 6:
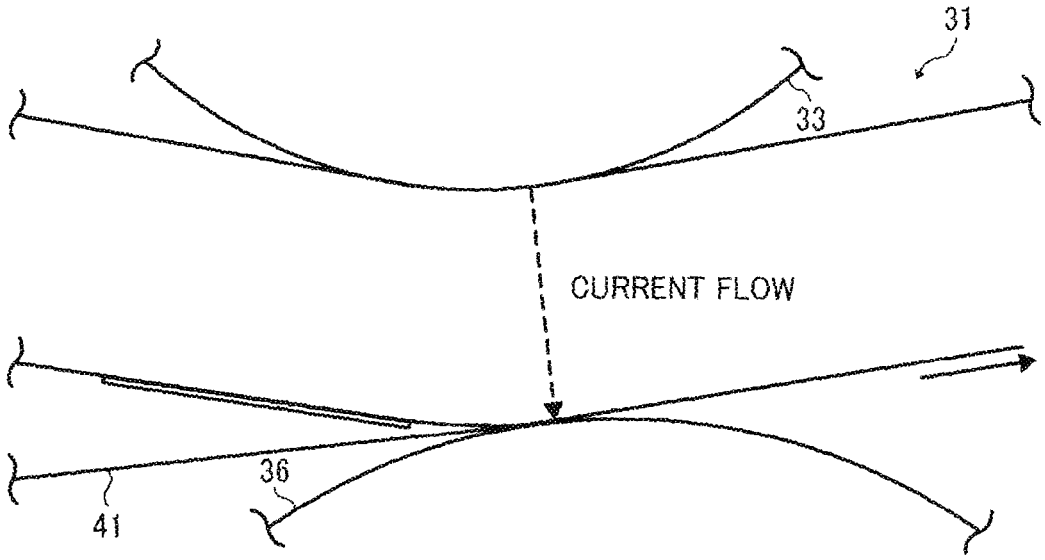
FIG. 6 is a diagram of the relations between variable ratios of a time period of application of an opposite-polarity voltage to a time period of one cycle of a voltage applied, and variable frequencies according to Comparative Example, Example 1, and Example 2.

FIG. 6 is an enlarged diagram schematically illustrating a structure around the secondary transfer nip using a single-layer intermediate transfer belt as the intermediate transfer belt 31. In a case in which the single-layer intermediate transfer belt is used as the intermediate transfer belt 31, a secondary transfer current flows between the secondary-transfer first roller 33 and the secondary-transfer second roller 36 in a manner described below. That is, the secondary transfer current is concentrated at the nip center (the center in the traveling direction of the belt) and flows linearly as indicated by an arrow in FIG. 6. In other words, the secondary transfer current does not flow much near the nip start portion of the secondary transfer nip and near the nip end portion of the secondary transfer nip. When the secondary transfer current flows in such a manner described above, the time period during which the secondary transfer current acts on the toner is relatively short at the secondary transfer nip. Accordingly, excessive injection of electrical charges having a polarity opposite that of the normal polarity due to the secondary transfer current is suppressed, if not prevented entirely.

Figure 7:
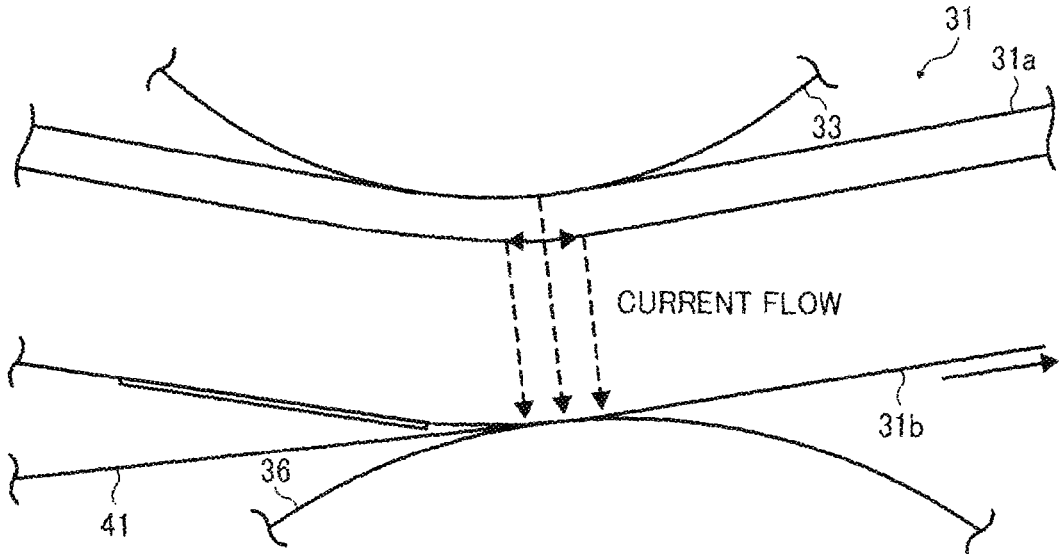
FIG. 7 is a diagram of evaluation of transferability depending on variable ratios of a time period of application of an opposite-polarity voltage to a time period of one cycle of a voltage applied, and variable frequencies according to Comparative Example, Example 1, and Example 2.

FIG. 7 is a partially enlarged cross-sectional view schematically illustrating the secondary transfer nip and a surrounding structure according to an embodiment of the present disclosure. According to the present embodiment, as described above, a multi-layer intermediate transfer belt is used as the intermediate transfer belt 31. In a case in which the multi-layer intermediate transfer belt is used as the intermediate transfer belt 31, a secondary transfer current flows between the secondary-transfer first roller 33 and the secondary-transfer second roller 36 in a manner described below. When using the multilayer intermediate transfer belt as the intermediate transfer belt 31, the secondary transfer current flows through an interface between the base layer 31*a* and the elastic layer 31*b* in the belt thickness direction while the secondary transfer current spreads in the circumferential direction of the intermediate transfer belt 31. As a result, the secondary transfer current flows not only in the center of the secondary transfer nip, but also at the nip start portion and at the nip end portion. This means that the secondary transfer current acts on the toner in the secondary transfer nip for an extended period of time. Thus, electrical charges having a polarity opposite to the normal polarity are easily and excessively injected to the toner due to the secondary transfer current, which results in a significant decrease in the amount of charge of the toner having the normal polarity and also results in a reverse charging of the toner. In both cases, the secondary transfer ability is impaired. As a result, the image density easily becomes insufficient. Not only the two-layer belt such as in the present embodiment, but also the belt having multiple layers including three more layers causes the similar spread of the secondary transfer current, which also impairs the secondary transfer ability.

Figure 8:
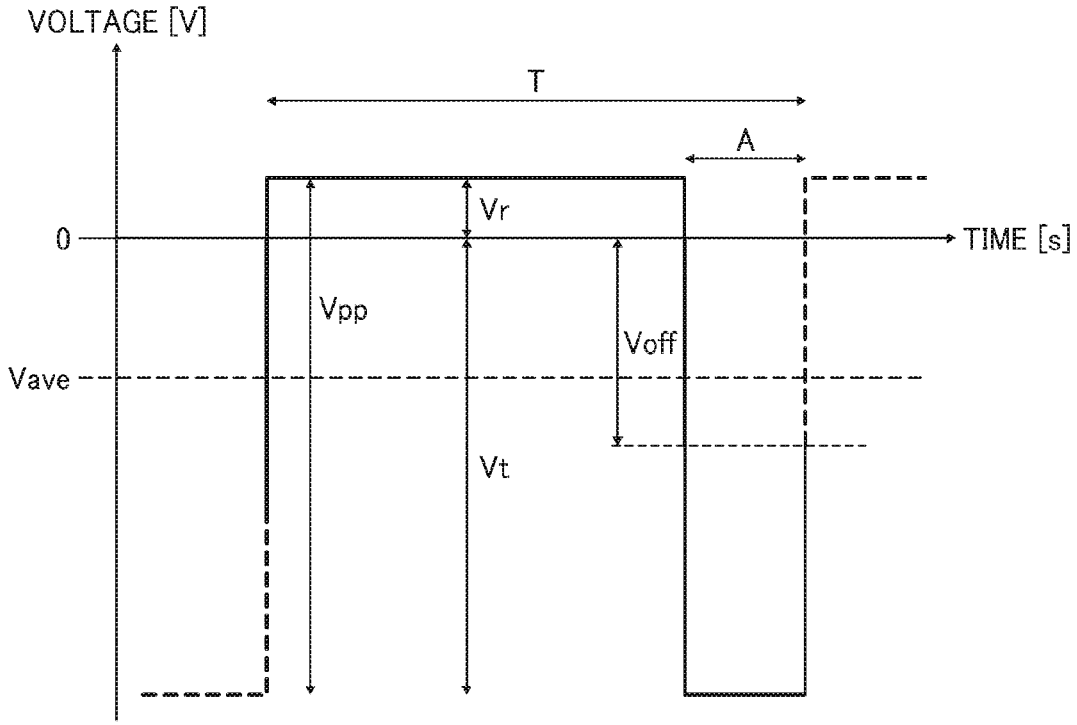
FIG. 8 is a diagram of ranking of transferability on a recess of a recording medium when only the time period of application of the opposite-polarity voltage is varied.

FIG. 8 is a waveform in chart showing a waveform m of a secondary bias output from the secondary transfer power source 39 according to an embodiment of the present disclosure. According to the present embodiment, the secondary transfer bias is applied to the secondary-transfer first roller 33. In this configuration, in order to secondarily transfer a toner image from the intermediate transfer belt 31 onto a recording sheet P, the secondary transfer bias having the characteristics described below is employed. That is, a time-averaged polarity of the secondary transfer bias is similar to or the same polarity as the charging polarity of toner. More specifically, the secondary transfer bias includes an alternating voltage that cyclically alternates the polarity between negative and positive because the AC voltage is superimposed on the DC voltage in the alternating voltage. On time average, the polarity of the secondary transfer bias is negative which is the same as the polarity of the toner. Using the secondary transfer bias having the negative time-averaged polarity, the toner is repelled relatively by the secondary-transfer first roller 33, thereby enabling the toner to electrostatically move from the intermediate transfer belt 31 toward the recording sheet P. In a case in which the secondary transfer bias is applied to the secondary-transfer second roller 36, the secondary transfer bias having the time-averaged polarity opposite to the polarity of the toner is used. With such a secondary transfer bias, the toner is electrostatically attracted relatively to the secondary-transfer second roller 36, thereby enabling the toner to electrostatically move from the intermediate transfer belt 31 toward the recording sheet P.

In FIG. 8, T refers to one cycle of the secondary transfer bias with the polarity that cyclically alternates. In FIG. 8, Vt refers to a transfer peak value. The transfer peak value Vt it is one of two peak values of the secondary transfer bias. The secondary transfer bias with the transfer peak value Vt applies a greater transfer-directional electrostatic force to toner in the secondary transfer nip to electrostatically move the toner from the intermediate transfer belt 31 toward the sheet conveyor belt 41. A peak value Vr is the other peak value of the two peak values of the secondary transfer bias. In other words, the peak value Vr is an opposite-peak value to the transfer peak value Vt. When the secondary transfer bias has a positive polarity, which is an opposite to the charging polarity of toner, electrostatic migration of the toner from the intermediate transfer belt 31 to the recording sheet P is inhibited. In contrast, when the secondary transfer bias has a negative polarity, which is the same as the charging polarity of toner, electrostatic migration of the toner from the intermediate transfer belt 31 to the recording sheet P is accelerated.

In FIG. 8, Voff represents an offset voltage as a DC component value of the secondary transfer bias and coincides with a solution to an equation (Vr+Vt)/2. Vpp represents a peak-to-peak value.

The secondary transfer bias has a waveform with a duty (i.e. duty ratio) greater than 50% in the cycle T. The duty (duty ratio) is a time ratio based on an inhibition time period during which the electrostatic migration of the toner from the intermediate transfer belt 31 to the recording sheet P in the secondary transfer nip is inhibited in a first time period and a second time period of the waveform. According to the present embodiment, the first time period is a time period in the cycle T of the waveform from when the secondary transfer bias starts rising beyond the zero line as the baseline towards the positive polarity side to a time after the secondary transfer bias falls to the zero line, but immediately before the secondary transfer bias starts falling from the zero line towards the negative polarity side. The second time period is a time period in the cycle T of the waveform from when the secondary transfer bias starts falling towards the negative polarity side from the zero line to a time after the secondary transfer bias rises to the zero line, but immediately before the secondary transfer bias starts further rising beyond the zero line towards the positive polarity side. In the first time period, the toner is prevented from electrostatically moving from the intermediate transfer belt 31 to the recording sheet P. In other words, the first time period corresponds to the inhibition time period. Therefore, the duty is the time ratio based on the first time period (during which the polarity is positive) in the cycle T. The duty of the secondary transfer bias of the image forming apparatus is obtained by the following equation: (T−A)/T×100 (%), where A is the second time period.

In FIG. 8, Vave represents an average potential of the secondary transfer bias and coincides with a solution to an equation "Vr×Duty/100+Vt×(1−Duty)/100". Furthermore, A represents the second time period (i.e., a time period obtained by subtracting the inhibition time period from the cycle T in the present embodiment.) T indicates a cycle of an alternating current component of the secondary transfer bias.

As illustrated in FIG. 8, in the secondary transfer bias, the time period during which the secondary transfer bias has a positive polarity is greater than half the cycle T. That is, the duty is greater than 50%. With such a secondary transfer bias, the time period, during which electrical charges having the positive polarity opposite to the charging polarity of the toner may possibly be injected to the toner in the cycle T, is shortened. Accordingly, a decrease in the charge amount of toner Q/M caused by the injection of the electrical charges in the secondary transfer nip can be suppressed, if not prevented entirely. With this configuration, degradation of the secondary transfer ability caused by a decrease in the charge amount of toner is prevented, hence obtaining sufficient image density. Even when the duty is greater than 50%, the toner image can be secondarily transferred in a manner described below. That is, an area of the positive side of the graph with 0V as a reference is smaller than that of the negative side of the graph so that the average potential has a negative polarity, thereby enabling the toner to electrostatically move relatively from the intermediate transfer belt 31 to the recording sheet P.

Figure 9:
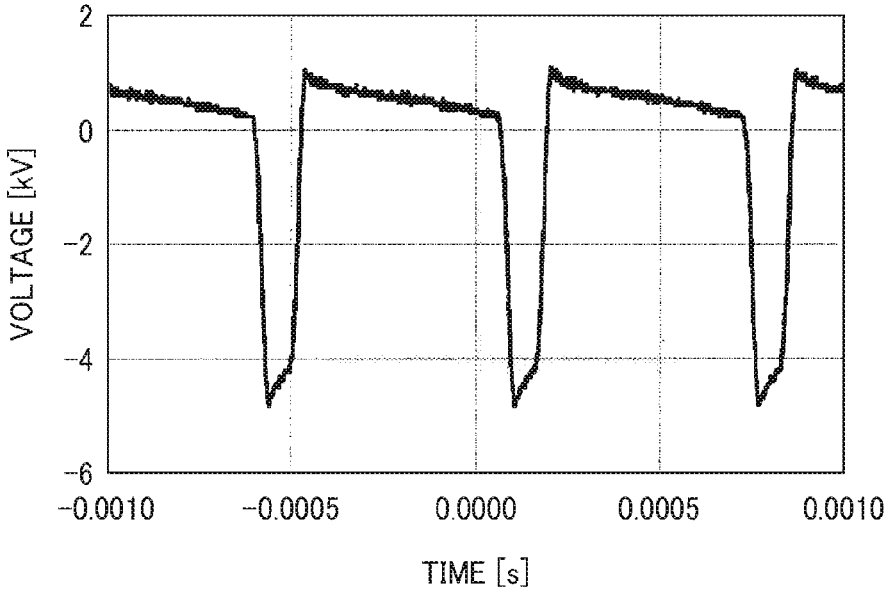
FIG. 9 is an enlarged view of a secondary transfer bias power source and a voltage supplied therefrom in an image forming apparatus according to a second embodiment of the present disclosure.

FIG. 9 is a waveform chart of a waveform of the secondary transfer bias, actually output from the secondary transfer power source 39 of a prototype image forming apparatus by the inventors of the present invention. In FIG. 9, the transfer peak value Vt is −4.8 kV. The reverse-polarity peak value Vr is 1.2 kV. The offset voltage Voff is −1.8 kV. The average potential Vave is 0.08 kV The peak-to-peak value Vpp is 6.0 kV. The second time period A is 0.10 ms. The cycle T is 0.66 ms. The duty is 85%.

The inventors of the present application has printed test images with variable duties of the secondary transfer bias, under the following conditions:

Environment condition: 27° C./80%
Type of recording sheet P: Coated sheet,:Mohawk Color Copy Gloss 270 gsm (457 mm×305 mm)
Process linear velocity: 630 mm/s
Test image: Black halftone image
Secondary transfer nip width (the length in a direction of movement of belt: 4 mm
Transfer peak value Vt: −4.8 kV
Opposite-polarity peak value Vr: 1.2 kV
Offset voltage Voff: −1.8 kV
Average potential Vave: 0.08 kV
Peak-to-peak value Vpp: 6.0 kV
Second time period A: 0.10 ms
Cycle T: 0.66 ms
Duty: 90%, 70%, 50%, 30%, and 10%

Figure 10:
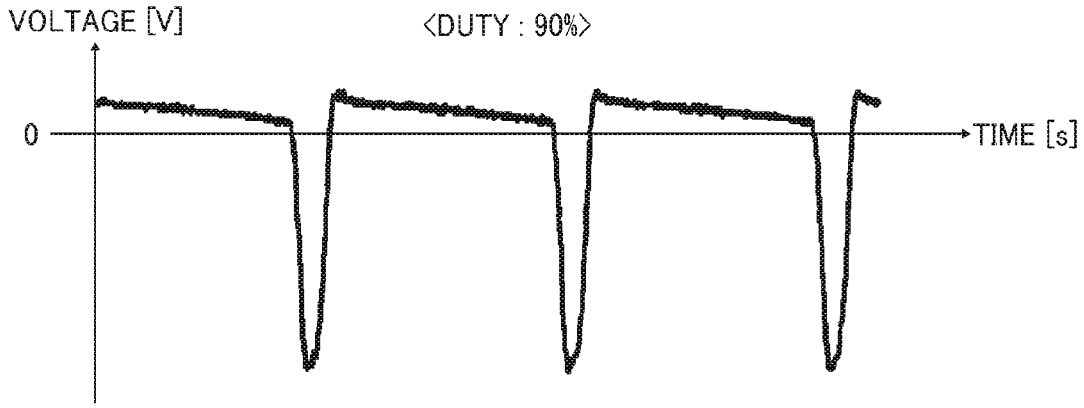
FIG. 10 is an enlarged view of a secondary transfer bias power source and a voltage supplied therefrom in an image forming apparatus according to a third embodiment of the present disclosure.
Figure 11:
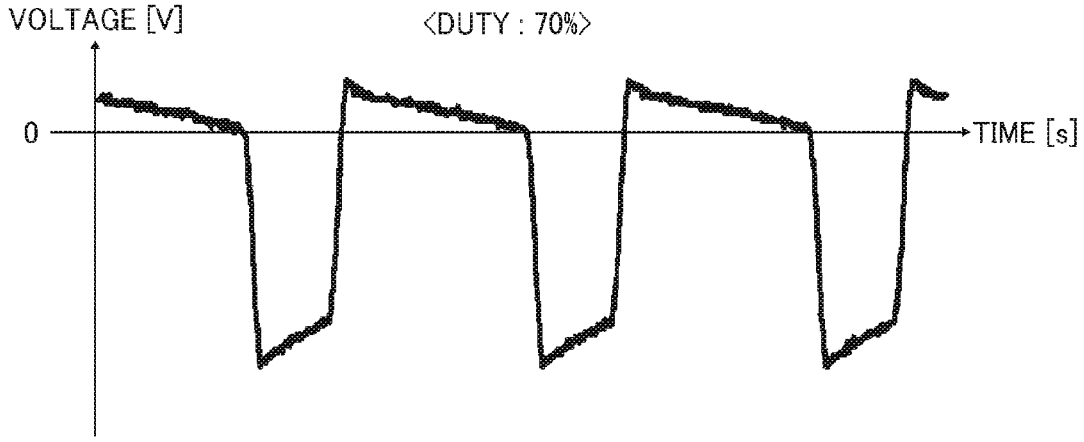
FIG. 11 is an enlarged view of a secondary transfer bias power source and a voltage supplied therefrom in an image forming apparatus according to a fourth embodiment of the present disclosure.
Figure 12:
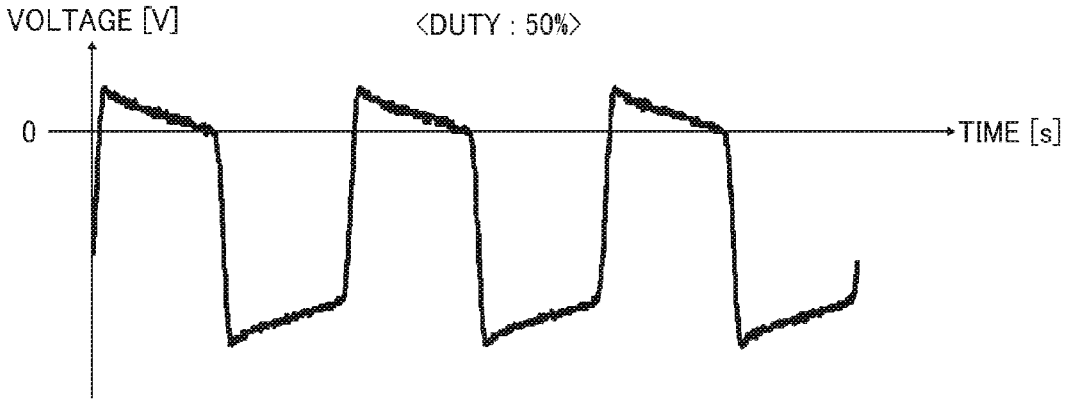
FIG. 12 is an enlarged view of a secondary transfer bias power source and a voltage supplied therefrom in an image forming apparatus according to a fifth embodiment of the present disclosure.
Figure 13:
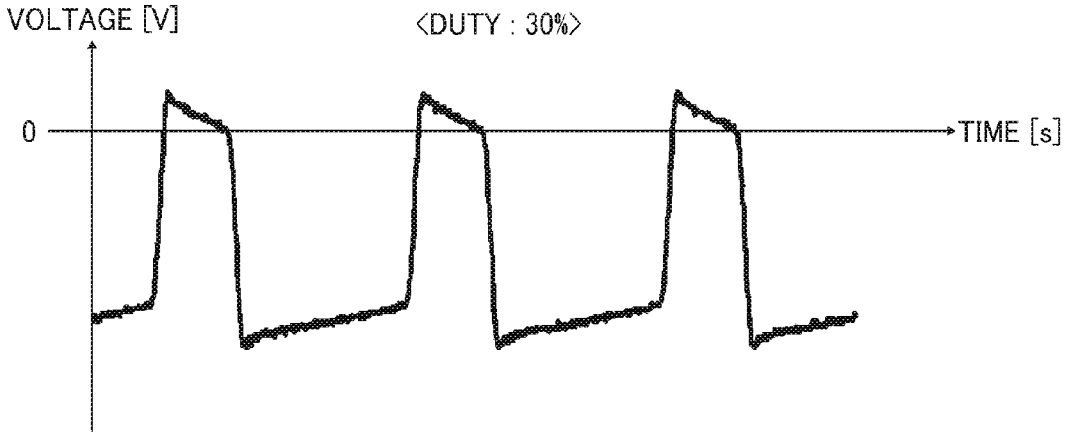
FIG. 13 is a waveform chart of a waveform of a secondary bias with a duty of 30% actually output from the secondary transfer power source of the prototype image forming apparatus.
Figure 14:
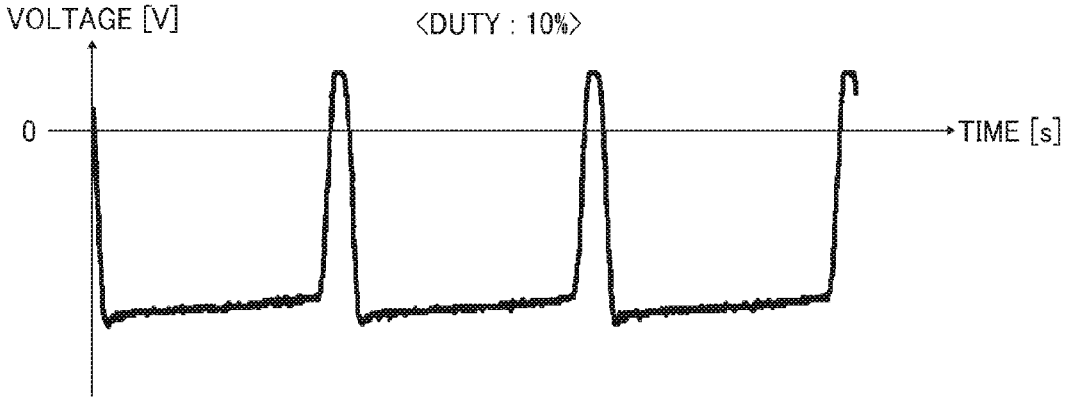
FIG. 14 is a waveform chart of a waveform of a secondary bias with a duty of 10% actually output from the secondary transfer power source of the prototype image forming apparatus.

FIG. 10 is a waveform chart of an actual output waveform of the secondary transfer bias with the duty of 90%. FIG. 11 is a waveform chart of an actual output waveform of the secondary transfer bias with the duty of 70%. FIG. 12 is a wavefoim chart of an actual output waveform of the secondary transfer bias with the duty of 50%. FIG. 13 is a waveform chart of an actual output waveform of the secondary transfer bias with the duty of 30%. FIG. 14 is a waveform chart of an actual output waveform of the secondary transfer bias with the duty of 10%.

The results are shown in Table 1.

TABLE 1

| DUTY (%) | 90 | 70 | 50 | 30 | 10 |
|---|---|---|---|---|---|
| EVALUATION OF TRANSFERABILITY | 5 | 5 | 3 | 1 | 1 |

In Table 1, reproducibility of image density of test images were graded on a five point scale of 1 to 5, with 5 indicating that the density of a halftone test image was sufficient. 4 indicates that the density was slightly lower than that of Grade 5, but the density was good enough so as not to cause a problem. 4 indicates that the density was slightly lower than that of Grade 5, but the density was good enough so as not to cause a problem. Grade 3 indicates that the density was lower than that of Grade 4, and desired image quality to satisfy users was not obtained. Grade 2 indicates that the density was lower than that of Grade 3. Grade 1 indicates that the test image looked generally white or even whiter (less density). The acceptable image quality to satisfy users was Grade 4 or above.

With the duty of 10% and 30%, the time period, during which electrical charges having the opposite polarity may possibly be injected to the toner in the cycle T, was relatively long. Therefore, a decrease in the charge amount of Loner Q/M due to the injection of reverse electrical charges was significant. As a result, as shown in Table 1, the image density was graded as Grade 1, which indicates that the image density was insufficient significantly.

By contrast, with the duty of 70% and 90%, the time period, during which electrical charges having the opposite polarity may possibly be injected to the toner in the cycle T, was relatively short. Therefore, a decrease in the charge amount of toner Q/M due to the injection of reverse electrical charges was suppressed effectively. As a result, as shown in Table 1, the image density was graded as Grade 5 which indicates that the desired image density was obtained.

As shown in the drawings, with the secondary transfer bias, the polarity of which alternately changes in the cycle T, the injection of reverse electrical charges to the toner can be prevented more reliably. In this configuration, even when the recording sheet P is charged the electric field having the polarity that prevents the injection of the reverse charges acts relatively in the secondary transfer nip.

The same experiments were performed using regular paper as the recording sheet P, instead of the above-described coated sheets. The experiment conditions are described below. Test conditions are as follows:

Environment condition: 27° C./80%
Type of recording sheet: Normal (regular paper)
Process linear velocity: 630 mm/s
Test image: Black halftone image
Secondary transfer nip width (the length in a direction of movement of belt: 4 mm
Transfer peak value Vt: −4.8 kV
Opposite-polarity peak value Vr: 1.2 kV
Offset voltage Voff: −1.8 kV
Average potential Vave: 0.08 kV
Peak-to-peak value Vpp: 6.0 kV
Second time period A: 0.10 ms
Cycle T: 0.66 ms
Duty: 90%, 70%, 50%, 30%, and 10%

The relations between the duty and the evaluation of the transferability were similar to the coated sheet shown in Table 1.

Generally, as illustrated in FIG. 9 through FIG. 14, the waveform of the secondary transfer bias including the superimposed voltage is not a clean square wave. If the waveform is a clean square wave, a time period from the rise of waveform to the fall of the waveform can be easily specified as the toner-transfer inhibition time period in one cycle. If the waveform is not such a clean square wave, the inhibition time period cannot be specified. That is, in a case in which a certain amount of time period is required (i.e., when the required time period is not zero) for the wave to rise from a first peak value (for example, the transfer peak value Vt) to a second peak value (for example, the reverse-polarity peak), or to fall from the second peak value to the first peak value, the above-described specifying process cannot be performed. In view of the above, if the waveform is not a clean square wave, the duty is defined as follows. That is, among one peak value (e.g., the first peak value) and another peak value (e.g., the second peak value) of two peak values of the secondary transfer bias that cyclically alternates, whichever inhibits more the electrostatic migration of toner from the intermediate transfer belt 31 to the recording sheet P in the secondary transfer nip, is defined as an inhibition peak value. According to the present embodiment, the peak value at the positive side is defined as the inhibition peak value. The position, at which the inhibition peak value is shifted towards the another peak value by an amount equal to 30% of the peak-to-peak value, is defined as the baseline of the waveform. A time period, during which the waveform is on the inhibition peak side relative to the baseline, is defined as an inhibition time period A'. More specifically, the inhibition time period A' is a time period from when the waveform starts rising or falling from the baseline towards the inhibition peak value to immediately before the waveform falls or rises to the baseline. The duty is defined as a ratio of the inhibition time period A' to the cycle T.

Figure 15:
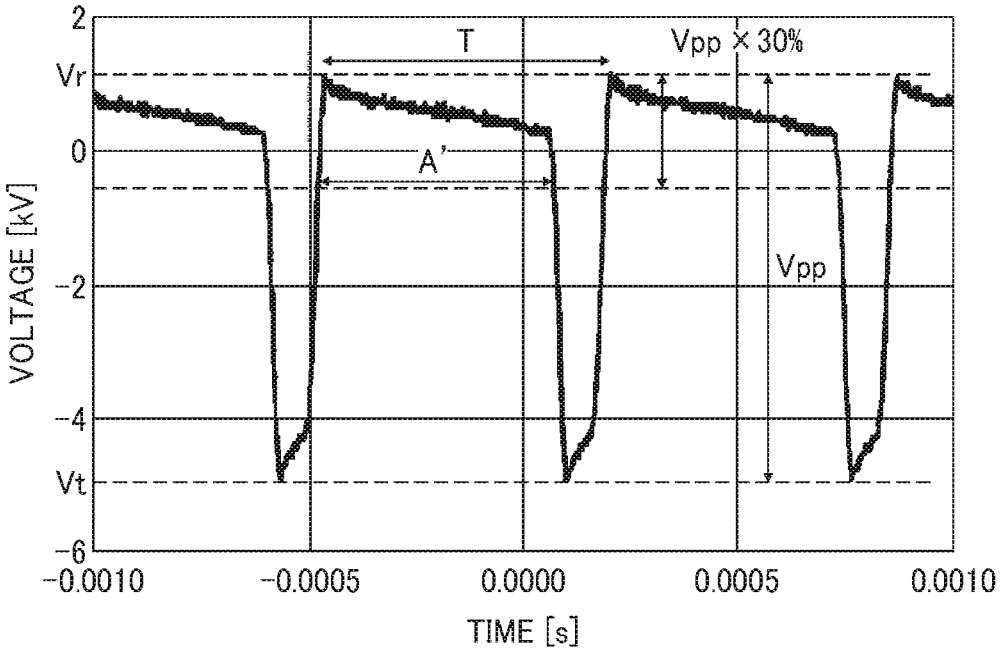
FIG. 15 is a graph for explaining a definition of the duty.

More specifically, a solution of an equation "(Inhibition time period A'/Cycle T)×100%" in FIG. 15 is obtained as the duty. According to the present embodiment, the toner having a negative polarity is used, and the secondary transfer bias is applied to the secondary-transfer first roller 33. That is, an opposite-polarity peak value Vr is the inhibition peak value. Thus, the opposite-polarity peak value Vr is the inhibition peak value. The inhibition time period A' is a time period from when the waveform starts rising from the baseline towards the opposite-polarity peak value Vr to a time after the waveform falls to the baseline, but immediately before the waveform starts falling further towards the transfer peak value Vt. By contrast, in a configuration in which the toner having a negative polarity is used and the secondary transfer bias is applied to the secondary-transfer second roller 36, the secondary transfer bias having a reversed waveform which is a waveform shown in FIG. 15 reversed at 0 V as a reference is used. In this case, the transfer peak value Vt is the inhibition peak value. The inhibition time period A' is a time period from when the waveform starts rising from the baseline towards the opposite-polarity peak value Vr to a time after the waveform falls to the baseline, but immediately before the waveform starts falling further towards the transfer peak value Vt.

According to the present embodiment, as the intermediate transfer belt 31, a belt with an upper most layer (i.e., the elastic layer 31*b*) in which particles (the particles 31*c*) are dispersed is used. With this configuration, a contact area of the belt surface with the toner in the secondary transfer nip can be reduced, and hence the ability of separation of the toner from the belt surface can be enhanced. The transfer rate can be enhanced. However, when the secondary transfer current flows concentrically between the insulating particles 31*c* which are arranged regularly, the electrical charges having an opposite polarity get injected easily to the toner. As a result, even when the particles 31*c* are dispersed to enhance the transfer rate, the secondary transfer rate may decrease. In view of this, the secondary transfer bias with a high duty is employed to reliably enhance the secondary transfer rate by the particles 31*c*.

As the particles 31*c*, particles having a charging property of an opposite polarity to the normal charging polarity of the toner are used. According to the present embodiment, the particles 31*c* are constituted of melamine resin particles having a positive charging property. With this configuration, electrical charges of the particles 31*c* suppress concentration of the secondary transfer current between the particles, hence further reducing the injection of opposite electrical charges to the toner.

Alternatively, in some embodiments, particles having a charge property of the same polarity as the normal charging polarity of the toner are used as the particles 31*c*. For example, silicone resin particles having a negative charge property (i.e., Tospearl (trade name)) can be used.

In some embodiments, the intermediate transfer belt 31 may include an uppermost layer made of urethane or Teflon (registered trademark). Alternatively, in some embodiment, the intermediate transfer belt 31 may include multiple layers made of resins such as polyimide and polyamide-imide. With either belt used, using the secondary transfer bias with a high duty can prevent insufficient image density, which is caused by injecting the electrical charges having the opposite polarity to toner in the secondary transfer nip.

For example, for an image forming apparatus described in US2012/045259 employing an intermediate transfer belt of a single-layer structure made of carbon dispersed polyimide, the surface of the intermediate transfer belt may not flexibly deform in accordance with the unevenness of the surface of a recording sheet having an uneven surface in a secondary transfer nip. Accordingly, tiny spaces are formed between recessed portions of the uneven surface of the recording sheet and the surface of the intermediate transfer belt 31 in the secondary transfer nip, which results in an insufficient amount of toner in the recessed portions. To sufficiently transfer toner onto the recessed portions of the uneven surface of the recording sheet, the secondary transfer bias including the superimposed voltage is applied to move toner back and forth between the belt surface and the recessed portions of the recording sheet. During this back-and-forth movement of toner, toner particles on the belt surface collide with toner particles moving from the recessed portions of the uneven surface of the recording sheet, thereby gradually increasing the amount of toner transferred onto the recessed portions along with the back-and-forth movement of toner. As a result, a sufficient amount of toner is transferred onto the recessed portions of the uneven surface of the recording sheet. The content of US2012/045259 is hereby incorporated by reference herein.

In contrast, in the image forming apparatus 1000 according to the present embodiment of the present disclosure, the intermediate transfer belt 31 includes the elastic layer 31*b*, which deforms in the secondary transfer nip to allow the surface of the intermediate transfer belt 31 to favorably fit into the recessed portions of the uneven surface of the recording sheet. Accordingly, using the secondary transfer bias including only the DC voltage, instead of the secondary transfer bias including the superimposed voltage, also successfully transfers the sufficient amount of toner onto the recessed portions of the uneven surface of the recording sheet. However, as described above, when the secondary transfer bias including only the DC voltage is applied to transfer toner onto a recoding sheet P having a smooth surface, such as a coated sheet or a plain sheet, insufficient image density occurs due to the injection of the electrical charge having the opposite polarity to toner in the secondary transfer nip. Such an insufficient image density means an insufficient amount of toner over the entire surface of the recording sheet, irrespective of the differences between the recessed portions and the raised portions.

In such a manner, in the image forming apparatus described in US2012/045259, the secondary transfer bias including the superimposed voltage is applied to obtain a favorable transferability on paper having an uneven surface. In contrast, in the image forming apparatus 1000 according to the present embodiment of the present disclosure, the secondary transfer bias including the superimposed voltage is applied to obtain a favorable transferability on plain paper having a smooth surface. That is, the image forming apparatus 1000 according to the present embodiment of the present disclosure applies the secondary transfer bias including the superimposed voltage to address a recording sheet having opposite characteristics to the recording sheet employed in US2012/045259.

Next, a description is provided of a characteristic configuration of the image forming apparatus 1000 according to the present embodiment of the present disclosure.

The primary transfer power source 500 outputs the primary transfer bias for each color of yellow, magenta, cyan, and black under constant current control. The primary transfer bias for each color of yellow, magenta, cyan, and black has a primary transfer bias value V1 (an electrical potential), which varies with fluctuations in electrical resistance of each of the primary transfer rollers 35Y, 35M, 35C, and 35K due to changes in environment conditions. The primary transfer bias value V1 is set to an amount to apply, to each primary transfer nip, a primary transfer bias to successfully primarily transfer a toner image from each of the photoconductors 2Y, 2M, 2C, and 2K onto the intermediate transfer belt 31 under certain environment conditions. Under the same environment conditions, if the primary transfer bias value V1 is set to an amount smaller than the above-described amount, a primary transfer failure may occur.

In contrast, the secondary transfer power source 39 also outputs the secondary transfer bias with the DC voltage under constant current control. Accordingly, the output value of the secondary transfer bias from the secondary transfer power source 39 varies with, e.g., fluctuations in electrical resistance of the secondary-transfer first roller 33 due to changes in environment conditions. The transfer peak value Vt of the secondary transfer bias also varies with the variation of the output value of the secondary transfer bias. The output secondary transfer bias intermittently has the transfer peak value Vt in a manner different from the manner of the secondary transfer bias including only the DC voltage, in which the secondary transfer bias maintains the transfer peak value Vt over the long time period. When the primary transfer power source 500 outputs a primary transfer bias of a value V1 having the absolute value $\alpha$ V under constant current control, the primary transfer power source 500 outputs the primary transfer bias including the superimposed voltage with a transfer peak value of α V. In this case, a successful primary transfer of a toner image fails because the output primary transfer bias intermittently has a transfer peak value of α V in a manner different from the manner of the DC voltage (the primary transfer bias including only the DC voltage) in which the primary transfer bias maintains a transfer peak value of α V over the long time period. In the case of the secondary transfer bias as well, when a transfer peak value Vr of the secondary transfer bias is smaller than a value of the primary transfer bias V1, a successful secondary transfer of the toner image fails, resulting in an insufficient image density due to the secondary transfer failure. Unlike the primary transfer nip, a transfer current is less likely to flow through the secondary transfer nip because a recording sheet having high resistance is placed in the secondary transfer nip. Accordingly, the secondary transfer failure deteriorates when the secondary transfer bias including the superimposed voltage with a transfer peak value smaller than the primary transfer bias value V1 is output, as compared to when the primary transfer bias including the superimposed voltage with a transfer peak value smaller than a primary transfer bias value V1 is output.

Further, in the image forming apparatus 1000 according to the present embodiment, the intermediate transfer belt 31 includes the elastic layer 31*b* that deforms in the secondary transfer nip to allow the surface of the intermediate transfer belt 31 to favorably fit into the recessed portions of the recording sheet P having an uneven surface. Such a configuration prevents toner particles to move back and forth between the surface of the intermediate transfer belt 31 and the recessed portions of the recording sheet P in the secondary nip portion. However, when the secondary transfer bias having the same polarity as a polarity of the transfer peak value (i.e., the same polarity as the polarity of toner) is applied, such a secondary transfer bias provides an entire toner image with an electrostatic force to move the toner image from the belt surface (the surface of the intermediate transfer belt 31) toward the sheet surface (the surface of the recording sheet P). In contrast, when the secondary transfer bias having a polarity opposite to the polarity of the transfer peak value (i.e., opposite to the polarity of toner) is applied, such a secondary transfer bias provides an entire toner image with an electrostatic force to move the toner image from the sheet surface toward the belt surface. The former electrostatic force is referred to as a transfer-directional electrostatic force, and the latter electrostatic force is referred to as a return-directional electrostatic force. When the absolute value of the opposite-polarity peak value Vr of the secondary transfer bias is greater than or equal to the absolute value of the primary transfer bias value V1, the return-directional electrostatic force increases to return the entire toner image having been attracted to the sheet surface with the transfer peak value Vt, back to the belt surface with the opposite-polarity peak value Vr. With the applied secondary transfer bias having a peak value that alternates between the transfer peak value Vt and the opposite-polarity peak value Vr, the entire toner image is alternately moved toward the sheet surface and toward the belt surface. The inventors of the present invention have found that an insufficient image density may easily occur in the solid image through such alternating of the peak value.

Further, the inventors of the present invention have also found, through experiments, that a favorable image density is obtained in the solid image when the opposite-polarity peak value Vr has the absolute value smaller than that of the primary transfer bias value V1. This is because, with the opposite-polarity peak value Vr having the absolute value smaller than that of the primary transfer bias value V1, the return-directional electrostatic force does not increase to return the entire toner image having been attracted onto the sheet surface to the belt surface with the opposite-polarity peak value Vr.

Therefore, the power source controller 200 controls the transfer peak value Vt and the opposite-polarity peak value Vr of the secondary transfer bias, and the primary transfer bias value V1 of each of yellow, magenta, cyan, and black, as follows:

The absolute value of the transfer peak value Vt is greater than the absolute value of the primary transfer bias value V1, and the absolute value of the opposite-polarity peak value Vr is smaller than the absolute value of the primary transfer bias value V1 (|Vt|>|V1|>|Vr|). To satisfy the above-described relation, an appropriate value is set for a target value of output current of the primary transfer bias for each of yellow, magenta, cyan and black, and for a target value of output current of the DC component of the secondary transfer bias.

Figure 16:
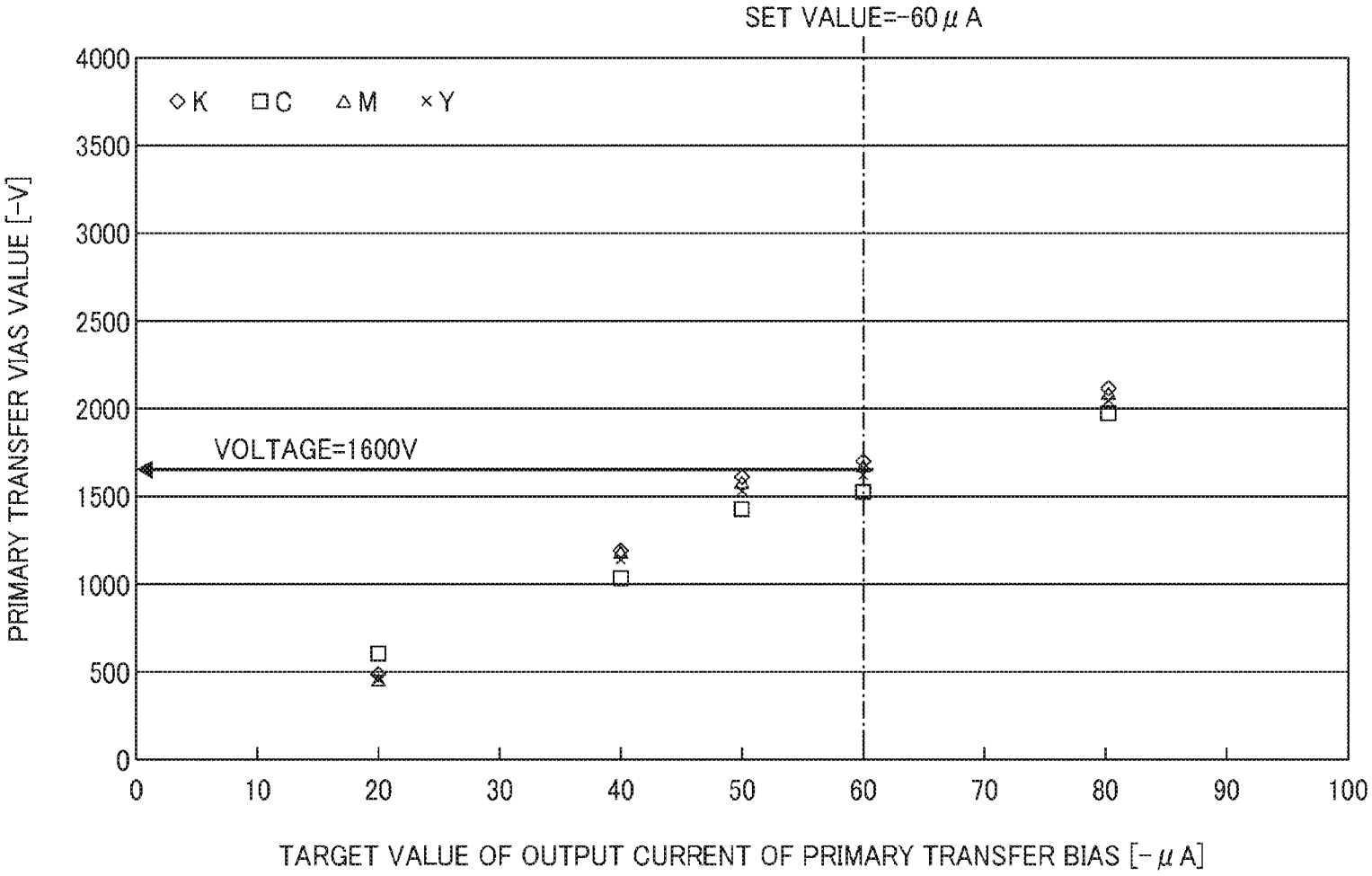
FIG. 16 is a graph of the relations between target values of output current of a primary transfer bias and values V1 of the primary transfer bias in the image fainting apparatus, at a temperature of 25° C. and a humidity of 50%.

FIG. 16 is a graph of the relations between the target values of output current of the primary transfer bias and values V1 of the primary transfer bias in the image fainting apparatus according to an embodiment under the environment conditions of a temperature of 25° C. and a humidity of 50%. Under the same environment conditions, as the target value of output current of the primary transfer bias increases, the value V1 of the primary transfer bias increases as well, as indicated in FIG. 16. In the image forming, apparatus of the present embodiment, the power source controller 200 controls the target value of output current for each of yellow, magenta, cyan and black to be 60 −μA. Accordingly, the value V1 of the primary transfer bias for each of yellow, magenta, cyan, and black is approximately 1600 −V at a temperature of 25° C. and a humidity of 50%. Hereinafter, the environment conditions of a temperature of 25° C. and a humidity of 50% is referred to as a "reference environment conditions".

The power source controller 200 controls the secondary transfer power source 39 to output a secondary transfer bias having a waveform with a duty of 90%, as illustrated in FIG. 9. The target value of output current of the DC component and the peak-to-peak potential Vpp are as follows:

Under the reference environment conditions, the transfer peak value Vt is −4.7 kV, and the opposite-polarity peak value Vr is 0.5 kV.

With the target value of output current of the primary transfer bias for each of yellow, magenta, cyan, and black and the target value of output current of the DC voltage of the secondary transfer bias set as described above, the transfer peak value Vt, the value V1 of the primary transfer bias, and the opposite-polarity peak value Vr under the reference environment conditions are as follows:

The absolute value of the transfer peak value Vt is 4.7 kV.

The absolute value of the value V1 of the primary transfer bias is 1.6 kV.

The absolute value of the opposite-polarity peak value Vt is 0.5 kV.

These values satisfy the relation of |Vt|>|V1| |Vr|.

With changes in the reference environment conditions, the value V1 of the primary transfer bias varies, and the transfer peak value Vt and the opposite peak value Vr vary as well. The inventors of the present invention has confirmed that irrespective of changes in the environment conditions, the relation of |Vt|>|V1| |Vr| is maintained.

In the image forming apparatus with the above-described configuration, with the absolute value of the transfer peak value Vt greater than the absolute value of the value V1 of the primary transfer bias, an insufficient level of an electrical field intensity is prevented in the secondary transfer nip, which further prevents the secondary transfer failure. As a result, the insufficient image density due to the secondary transfer failure is reduced. Further, with the absolute value of the opposite-polarity peak value Vr of the secondary transfer bias smaller than the absolute value of the value V1 of the primary transfer bias, a subsequent occurrence of another insufficient image density is prevented. The subsequent occurrence of another insufficient image density refers to the occurrence of an insufficient image density caused by causing the entire toner image having been attracted to the sheet surface with the transfer peak value Vt to return to the belt surface with the opposite-polarity peak value.

Although the embodiment of the present disclosure has been described above, the present disclosure is not limited to the foregoing embodiments, but a variety of modifications can naturally be made within the scope of the present disclosure.

[Aspect A]

According to Aspect A, an image forming apparatus includes: an image bearer (for example, photoconductors 2Y, 2M, 2C, and 2K) having a surface to bear a toner image; a toner image forming device (for example, an optical writing unit 80, image forming units 1Y, 1M, 1C, and 1K) configured to form the toner image on the surface of the image bearer; an intermediate transferor (for example, an intermediate transfer belt 31) configured to contact the surface of the image bearer to form a primary transfer nip; a primary transfer power source (for example, a primary transfer power source 500) configured to output a primary transfer bias including only a direct current voltage to the primary transfer nip to transfer the toner image from the surface of the image bearer onto a surface of the intermediate transferor; a secondary transfer nip forming device (for example, a sheet conveyor belt 41) configured to contact the intermediate transferor to form a secondary transfer nip; and a secondary transfer power source (for example, a secondary transfer power source 39) configured to output a secondary transfer bias including a superimposed voltage, in which an alternating current voltage is superimposed on the direct current voltage, to the secondary transfer nip to secondarily transfer the toner image from the intermediate transferor onto a recording medium disposed in the secondary transfer nip. One of two peak values of the secondary transfer bias is a transfer peak value to provide a greater transfer-directional electrostatic force to move toner from the into mediate transferor toward the recording medium in the secondary transfer nip. An absolute value of the transfer peak value is greater than an absolute value of the primary transfer bias.

Hereinafter, among two peak values of the transfer bias including the superimposed voltage, whichever accelerates more the electrostatic migration of toner from an initial position (for example, an intermediate transferor) to a destination (for example, a recording sheet) in a transfer nip, is defined as a transfer peak value. The other peak value is defined as an opposite-polarity peak value.

In the image forming apparatus that applies the secondary transfer bias including the superimposed voltage according to Aspect A, the primary transfer bias is set as follows: When a primary transfer bias has an absolute value of $\alpha$ V to allow a successful primarily transfer of a toner image, the primary transfer power source outputs a primary transfer bias including the superimposed voltage with a transfer peak value of $\alpha$ V, instead of a primary transfer bias including only the DC voltage. In this case, in the output primary transfer bias, a transfer peak value of $\alpha$ V intermittently occurs, failing to remains unchanged over a long time period, unlike in the primary transfer bias including only the DC voltage. As a result, a primary transfer failure may occur when the primary transfer bias including the superimposed voltage is applied. In the case of the secondary transfer bias as well, when the secondary transfer bias with a transfer peak value smaller than that of the primary transfer bias is applied, a successful secondary transfer of a toner image is inhibited, resulting in an insufficient image density due to the secondary transfer failure. The secondary transfer nip is less likely to allow a transfer current to flow through the secondary transfer nip because a recording sheet having a high resistance is placed in the secondary transfer nip, unlike in the primary transfer nip.

According to Aspect A, with the absolute value of the transfer peak value Vt of the secondary transfer bias greater than the absolute value of the primary transfer bias, the image density failure due to the secondary transfer failure is prevented.

[Aspect B]

According to Aspect A, an absolute value of an opposite-polarity peak value of two peak values of the secondary transfer bias is smaller than the absolute value of the primary transfer bias.

In the configuration that applies the secondary transfer bias including the superimposed voltage according to Aspect A, the secondary transfer bias having a same polarity as the polarity of the transfer peak value provides an electrostatic force to move an entire toner image from a belt surface toward a sheet surface within a secondary transfer nip. In contrast, the secondary transfer bias having a same polarity as the polarity of the opposite-polarity peak value provides an electrostatic force (a return-directional electrostatic force) to move the entire toner image from the sheet surface toward the belt surface within the secondary transfer nip. In such a configuration that changes the direction of the electrostatic force, when the absolute value of the opposite-polarity peak value of the secondary transfer bias is set greater than or equal to the absolute value of the primary transfer bias value V1, the value of the return-directional electrostatic force is as follows:

The return-directional electrostatic force increases to return the entire toner image having been attracted to the sheet surface with the transfer peak value, back to the belt surface with the opposite-polarity peak value. With the applied secondary transfer bias having a peak value that alternates between the transfer peak value and the opposite-polarity peak value, the entire toner image is alternately moved toward the sheet surface and toward the belt surface. The inventors of the present invention have found that an insufficient image density may easily occur in the solid image through such alternating of the peak value. Further, the inventors of the present invention have also found, through experiments, that a favorable image density is obtained in the solid image when the opposite-polarity peak value has the absolute value smaller than that of the primary transfer bias value. This is because, with the opposite-polarity peak value having the absolute value smaller than that of the primary transfer bias value V1, the return-directional electrostatic force does not become so large as to return the entire toner image having been attracted onto the sheet surface to the belt surface with the opposite-polarity peak value.

Therefore, according to Aspect B, with the absolute value of the opposite-polarity peak value smaller than the absolute value of the primary transfer bias, a toner image having been attracted to the surface of the recording sheet with the transfer peak value is prevented from returning to the surface of the intermediate transfer belt with the opposite-polarity peak value, which reduces or eliminates an insufficient image density.

[Aspect C]

According to Aspect B, the intermediate transferor is an intermediate transfer belt including an endless base and an elastic layer on the base. In the configuration, even when a paper having an uneven surface is used as a recording sheet, the elastic layer of the intermediate transferor easily deforms according to the unevenness of the sheet surface in the secondary transfer nip, which allows the elastic layer to favorably fit into the recessed portions of the uneven surface of the recording sheet. This allows a successful secondary transfer of toner from the intermediate transferor onto the recessed portions of the uneven surface.

[Aspect D]

According to Aspect C, the elastic layer is an elastic surface layer having a plurality of fine projections made of a plurality of fine particles dispersed in a material of the elastic surface layer. With this configuration, the plurality of fine projections in the surface of the elastic layer reduce the contact area of the elastic layer with the toner in the secondary transfer nip, hence enhancing the ability of separation of the toner separating from the image bearer surface and thus enhancing the transfer rate.

[Aspect E]

According to Aspect D, as the fine particles, the fine particles have a charging property of an opposite polarity to a normal charging polarity of the toner. With this configuration, electrical charges of the particles reduces concentration of the transfer current between the particles, hence further reducing the injection of opposite electrical charges to the toner.

[Aspect F]

According to Aspect D, the fine particles have a charging property of a same polarity as a normal charging polarity of the toner.

[Aspect G]

According to Aspect C, the intermediate transfer belt includes a coating layer on the elastic layer. With this configuration, even when the secondary transfer bias spreads to an interface between the elastic layer and the coating layer, the injection of opposite electrical charges to the toner due to such a spread is prevented.

[Aspect H]

According to any one of Aspects C through G, the intermediate transfer belt includes two resin layers directly overlapping with each other. With this configuration, even when the secondary transfer bias spreads to an interface between two resin layers in a direction of the surface of the intermediate transferor, the injection of opposite electrical charges to the toner due to the spread of the secondary transfer bias is prevented.

[Aspect I]

According to Aspects A through H, the primary transfer power source outputs the primary transfer bias under constant current control. With this configuration, the target value of output current of the primary transfer bias is adjusted to adjust the absolute value of the primary transfer bias.

[Aspect J]

According to Aspect the secondary transfer power source outputs the secondary transfer bias with the DC component under constant current control. With this configuration, the target value of output current of each of the primary transfer bias and the secondary transfer bias is adjusted to set the absolute value of the transfer peak value greater than the absolute value of the primary transfer bias.

[Aspect K]

An image forming apparatus includes: an image bearer having a surface to bear a toner image; a toner image forming device configured to form the toner image on the surface of the image bearer; an intermediate transferor configured to contact the surface of the image bearer to form a primary transfer nip; a primary transfer power source configured to output a primary transfer bias including only a direct current voltage to the primary transfer nip to transfer the toner image from the surface of the image bearer onto a surface of the intermediate transferor; a secondary transfer nip forming device configured to contact the intermediate transferor to form a secondary transfer nip; and a secondary transfer power source configured to output a secondary transfer bias including a superimposed voltage, in which an alternating current voltage is superimposed on the direct current voltage, to the secondary transfer nip to secondarily transfer the toner image from the intermediate transferor onto a recording medium disposed in the secondary transfer nip. One of two peak values of the secondary transfer bias is a transfer peak value to provide a greater transfer-directional force to move toner from the intermediate transferor toward the recording medium in the secondary transfer nip. An absolute value of an opposite-polarity peak value having an opposite polarity to a polarity of the transfer peak value is smaller than an absolute value of the primary transfer bias. With this configuration, with the absolute value of the opposite-polarity peak value smaller than the absolute value of the primary transfer bias, a toner image having been attracted to the surface of the recording sheet with the transfer peak value is prevented from returning to the surface of the intermediate transfer belt with the opposite-polarity peak value, which reduces an insufficient image density.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer having a surface to bear a toner image;

a toner image forming device configured to form the toner image on the surface of the image bearer;

an intermediate transferor configured to contact the surface of the image bearer to form a primary transfer nip;

a primary transfer power source configured to output a primary transfer bias including only a direct current voltage to the primary transfer nip to transfer the toner image from the surface of the image bearer onto a surface of the intermediate transferor;

a secondary transfer nip forming device configured to contact the intermediate transferor to form a secondary transfer nip; and a secondary transfer power source configured to output a secondary transfer bias including a superimposed voltage, in which an alternating current voltage is superimposed on the direct current voltage, to the secondary transfer nip to secondarily transfer the toner image from the intermediate transferor onto a recording medium disposed in the secondary transfer nip, wherein one of two peak values of the secondary transfer bias is a transfer peak value to provide a greater transfer-directional electrostatic force to move toner from the intermediate transferor toward the recording medium in the secondary transfer nip than a transfer-directional electrostatic force of another of the two peak values, wherein an absolute value of the transfer peak value is greater than an absolute value of the primary transfer bias;

wherein a value of a time-averaged potential of the secondary transfer bias is closer to said another of the two peak values than a center value of the two peak values of the secondary transfer bias, and wherein an absolute value of the primary transfer bias is greater than an absolute value of the time-averaged potential of the secondary transfer bias.

2. The image forming apparatus according to claim 1 wherein the intermediate transferor is an intermediate transfer belt including an endless base and an elastic layer on the base, and wherein the elastic layer has a greater elasticity than the base.

3. The image forming apparatus according to claim 2, wherein the elastic layer is an elastic surface layer having a plurality of fine projections made of a plurality of fine particles dispersed in a material of the elastic surface layer.

4. The image forming apparatus according to claim 3, wherein the fine particles have a charging property of an opposite polarity to a normal charging polarity of the toner.

5. The image forming apparatus according to claim 3, wherein the fine particles have a charging property of a same polarity as a normal charging polarity of the toner.

6. The image forming apparatus according to claim 2, wherein the intermediate transfer belt includes a coating layer on the elastic layer.

7. The image forming apparatus according to claim 2, wherein the elastic layer and the base are directly overlapping with each other.

8. The image forming apparatus according to claim 1, wherein the primary transfer power source outputs the primary transfer bias under constant current control.

9. An image forming apparatus, comprising:

an image bearer having a surface to bear a toner image;

a toner image forming device configured to form the toner image on the surface of the image bearer;

an intermediate transferor configured to contact the surface of the image bearer to form a primary transfer nip;

a primary transfer power source configured to output a primary transfer bias including only a direct current voltage to the primary transfer nip to transfer the toner image from the surface of the image bearer onto a surface of the intermediate transferor;

a secondary transfer nip forming device configured to contact the intermediate transferor to form a secondary transfer nip; and a secondary transfer power source configured to output a secondary transfer bias including a superimposed voltage, in which an alternating current voltage is superimposed on the direct current voltage, to the secondary transfer nip to secondarily transfer the toner image from the intermediate transferor onto a recording medium disposed in the secondary transfer nip, wherein one of two peak values of the secondary transfer bias is a transfer peak value to provide a greater transfer-directional force to move toner from the intermediate transferor toward the recording medium in the secondary transfer nip than a transfer-directional force of another of the two peak values which is an opposite-polarity peak, wherein the absolute value of an opposite-polarity peak value having an opposite polarity to a polarity of the transfer peak value is smaller than an absolute value of the primary transfer bias, wherein a value of a time-averaged potential of the secondary transfer bias is closer to said another of the two peak values than a center value of the two peak values of the secondary transfer bias, and wherein an absolute value of the primary transfer bias is greater than an absolute value of the time-averaged potential of the secondary transfer bias.

10. The image forming apparatus according to claim 1, wherein:

a duty ratio of the secondary transfer bias is greater than 50%, and the duty ratio is:

$$(T-A)/T\times 100(\%),$$

where:

A is a time period in which a voltage having said one of the two peak values is output by the secondary transfer power source, and T is one cycle of a waveform of the secondary transfer bias.

11. The image forming apparatus according to claim 1, wherein:

a duty ratio of the secondary transfer bias is greater than 50%, and wherein the duty ratio is:

$$A'/T\times 100(\%),$$

where:

A' is a time period in which a voltage that is closer to said another of the two peak values than a baseline is output by the secondary transfer power source, a position, at which said another of the two peak values is shifted towards said one of the two peak values by an amount equal to 30% of a peak-to-peak value of the secondary transfer bias, in a waveform of the secondary transfer bias is defined as the baseline, and T is one cycle of the waveform of the secondary transfer bias.

12. The image forming apparatus according to claim 9, wherein:

a duty ratio of the secondary transfer bias is greater than 50%, and the duty ratio is:

$$(T-A)/T\times 100(\%),$$

where:

A is a time period in which a voltage having said one of the two peak values is output by the secondary transfer power source, and T is one cycle of a waveform of the secondary transfer bias.

13. The image forming apparatus according to claim 9, wherein:

a duty ratio of the secondary transfer bias is greater than 50%, and wherein the duty ratio is:

$$A'/T\times 100(\%),$$

where:

A' is a time period in which a voltage that is closer to said another of the two peak values than a baseline is output by the secondary transfer power source, a position, at which said another of the two peak values is shifted towards said one of the two peak values by an amount equal to 30% of a peak-to-peak value of the secondary transfer bias, in a waveform of the secondary transfer bias is defined as the baseline, and T is one cycle of the waveform of the secondary transfer bias.

* * * * *